US007871239B2

(12) United States Patent
Sorokes

(10) Patent No.: US 7,871,239 B2
(45) Date of Patent: Jan. 18, 2011

(54) MULTI-SEGMENT COMPRESSOR CASING ASSEMBLY

(75) Inventor: James M. Sorokes, Olean, NY (US)

(73) Assignee: Dresser-Rand Company, Olean, NY (US)

( * ) Notice: Subject to any disclaimer, the term of this patent is extended or adjusted under 35 U.S.C. 154(b) by 927 days.

(21) Appl. No.: 11/701,831

(22) Filed: Feb. 2, 2007

(65) Prior Publication Data

US 2007/0183892 A1 Aug. 9, 2007

Related U.S. Application Data

(60) Provisional application No. 60/765,029, filed on Feb. 3, 2006.

(51) Int. Cl.
*F04D 29/40* (2006.01)

(52) U.S. Cl. ..... 415/116; 415/199.2; 415/214.1; 415/912; 416/201 R; 417/250

(58) Field of Classification Search ..... 415/116, 415/199.1, 199.2, 199.3, 214.1, 912; 416/201 R; 417/250

See application file for complete search history.

(56) References Cited

U.S. PATENT DOCUMENTS

| | | | | |
|---|---|---|---|---|
| 681,581 | A * | 8/1901 | Richards | 415/104 |
| 790,795 | A * | 5/1905 | Lea et al. | 415/106 |
| RE12,584 | E | 12/1906 | Lea et al. | |
| 981,021 | A * | 1/1911 | Snow | 415/169.2 |
| 2,678,606 | A | 5/1954 | Watson | |
| 2,924,292 | A * | 2/1960 | Hickman | 202/182 |
| 3,658,442 | A | 4/1972 | Heitmann et al. | |
| 3,764,236 | A * | 10/1973 | Carter | 417/372 |
| 3,907,455 | A | 9/1975 | Monsarrat | |
| 3,963,371 | A * | 6/1976 | Sieghartner | 415/55.6 |
| 3,976,395 | A | 8/1976 | Kalnin et al. | |
| 4,887,940 | A * | 12/1989 | Todoroki et al. | 415/199.1 |
| 4,969,803 | A | 11/1990 | Turanskyj | |
| 5,358,378 | A | 10/1994 | Holscher | |
| 6,506,018 | B1 * | 1/2003 | Brennan | 415/214.1 |
| 7,377,744 | B2 * | 5/2008 | Urban et al. | 415/199.1 |

* cited by examiner

*Primary Examiner*—Edward Look
*Assistant Examiner*—Ryan H Ellis
(74) *Attorney, Agent, or Firm*—Edmonds & Nolte, PC

(57) ABSTRACT

A casing assembly for a compressor includes an internal compression assembly with a shaft and at least one impeller disposed on the shaft. The casing assembly includes an inlet body segment having a fluid inlet, an outlet body segment having a fluid outlet, and a number of intermediate body segments selected from a plurality of intermediate body segments, which are preferably preformed. The intermediate segments are disposed between the inlet and outlet segments to form the casing and each has an inner circumferential surface defining an interior chamber section, the chamber sections collectively defining at least a portion of a compressor chamber sized to receive the compression assembly. Preferably, the intermediate segment inner surfaces have equal inside diameters and are generally coaxially aligned. As such, the inner surfaces collectively define a portion of continuous compressor support surface of a desired axial length for supporting the compression assembly.

49 Claims, 15 Drawing Sheets

MULTI-SEGMENT COMPRESSOR CASING ASSEMBLY

This application claims priority to U.S. Provisional Application Ser. No. 60/765,029, filed Feb. 3, 2006, the entire contents of which are incorporated herein by reference.

The present invention relates to fluid machinery, and more specifically to casings for centrifugal compressors.

Centrifugal compressors typically include a casing for housing the "working" components or internal compression assembly of the compressor. The compression assembly generally includes a rotatable shaft and at least one compressor stage, including an impeller disposed on the shaft and a fixed flow path assembly extending about the impeller. Basically the casing includes one or more interior chambers for receiving the compression assembly, at least one fluid inlet and at least one fluid outlet. Further, such casings were typically formed of two connected-together shell halves sized to accommodate a specific compression assembly and any associated components.

SUMMARY OF THE INVENTION

In one aspect, the present invention is a casing assembly for a compressor, the compressor including an internal compression assembly having a shaft rotatable about a central axis and at least one compressor stage with an impeller disposed on the shaft. The casing assembly comprises an inlet body segment having a fluid inlet, an outlet body segment having a fluid outlet, and a number of intermediate body segments selected from a plurality of intermediate body segments. The selected number of intermediate segments are disposed between the inlet and outlet body segments to form the compressor casing. Each intermediate segment has an inner circumferential surface defining an interior chamber section, the chamber sections of the connected intermediate body segments collectively defining at least a portion of a compressor chamber sized to receive the internal compression assembly.

In another aspect, the present invention is again a casing assembly for a compressor, the compressor having a centerline and including an internal compression assembly with a shaft rotatable about a central axis coaxially aligned with the centerline and at least one compressor stage with an impeller disposed on the shaft. The casing assembly comprises a first end body segment, and second end body segment spaced along the centerline from the first end body segment, and a plurality of intermediate body segments disposed between and connected with the first and second end segments to form the compressor casing. Each intermediate segment has an inner circumferential surface with an inside diameter. The inside diameter of each intermediate segment inner circumferential surface is substantially equal to the inside diameter of each other intermediate segment inner surface and the inner surfaces are generally coaxially aligned. As such, the inner surfaces collectively define at least a portion of a generally continuous compressor support surface configured to support at least a portion of the internal compression assembly.

In a further aspect, the present invention is once again a casing assembly for a compressor, the compressor including an internal compression assembly having a shaft rotatable about a central axis and at least one compressor stage with an impeller disposed on the shaft. The casing assembly comprises an inlet body segment having a fluid inlet and an outlet body segment having a fluid outlet. At least one first intermediate body segment is directly connected with the inlet body segment and has an inner circumferential surface with a first inside diameter. Further, at least one second intermediate body segment is directly connected with the outlet body segment and with the at least one first intermediate body segment to form a compressor casing. The at least one second intermediate body segment has an inner circumferential surface with a second inside diameter, the first inside diameter being substantially larger than the second inside diameter.

In yet another aspect, the present invention is a method of forming a casing assembly for a compressor including an internal compression assembly having a shaft rotatable about a central axis and at least one compressor stage with an impeller disposed on the shaft, the at least one compressor stage having an axial length. The method comprises the steps of: providing an inlet body segment having a fluid inlet and an outlet body segment having a fluid outlet; providing a plurality of intermediate body segments, each intermediate body segment having an inner surface defining an interior chamber section and an axial length; selecting a number of intermediate body segments from the plurality of intermediate body segments such that the selected number of intermediate body segments collectively define a compressor chamber section with a predetermined length, the predetermined length being at least a portion of the compressor stage length such that the compressor chamber section is sized to receive at least a portion of the compression assembly; and connecting the selected number of intermediate body segments at least one of with each other and with the inlet and outlet body segments to form a casing assembly.

In yet a further aspect, the present invention is a method of forming a casing assembly for a compressor including an internal compression assembly having a shaft rotatable about a central axis and at least one compressor stage with an impeller disposed on the shaft, the at least one compressor stage having an axial length. The method comprising the steps of: providing an inlet body segment having a fluid inlet and an outlet body segment having a fluid outlet; providing a plurality of intermediate body segments, at least one of the intermediate body segments being an intermediate inlet segment having a fluid inlet; selecting a number of the intermediate body segments, the number of intermediate body segments one of including the at least one intermediate inlet body segment and excluding the at least one intermediate inlet segment; and connecting the selected number of intermediate body segments at least one of with each other and with the inlet and outlet body segments to form a casing assembly.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
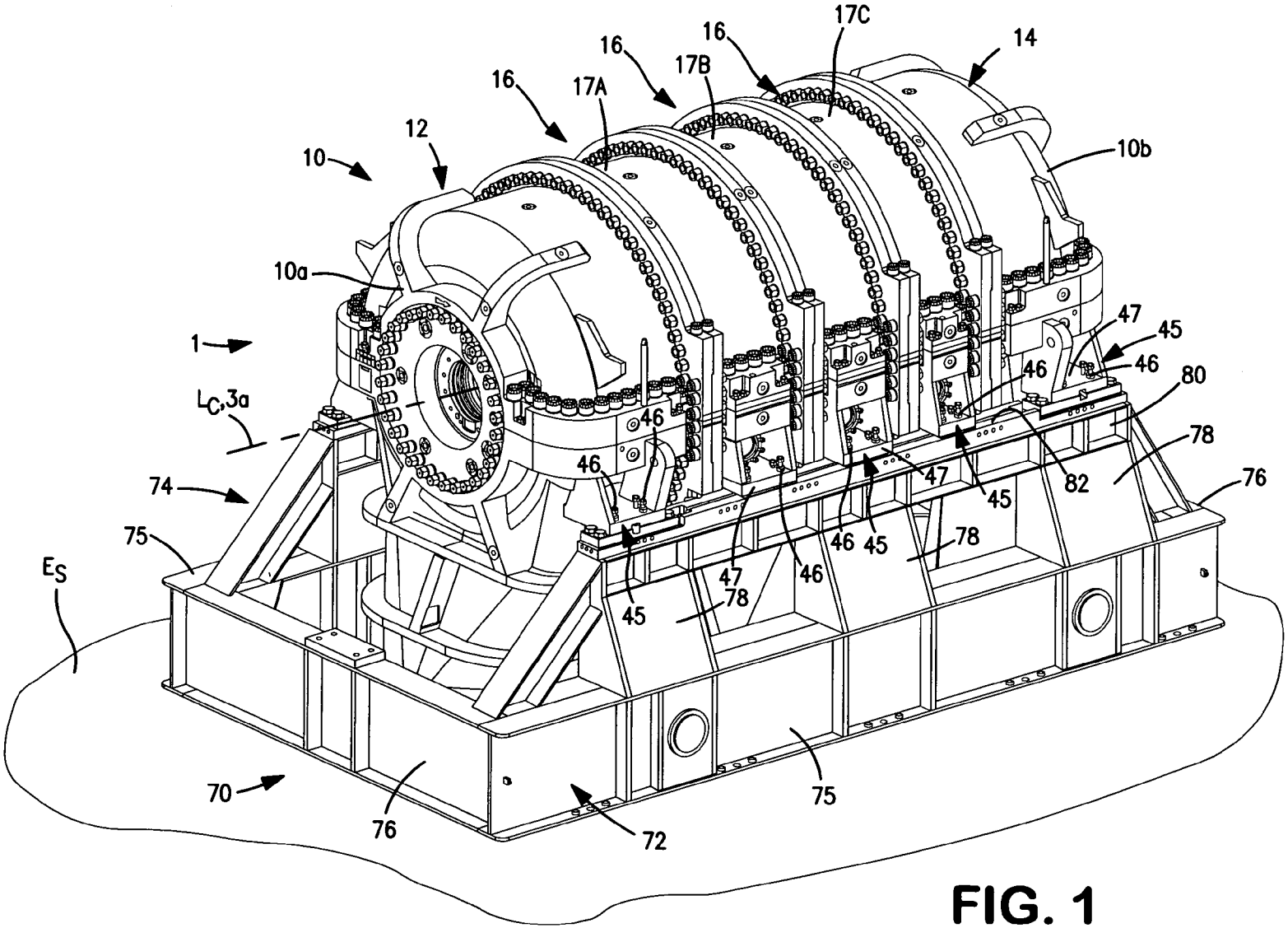
FIG. 1 is a front perspective view of a compressor casing assembly in accordance with a first construction of the present invention.

Certain terminology is used in the following description for convenience only and is not limiting. The words "right", "left", "lower", "upper", "upward", "down" and "downward" designate directions in the drawings to which reference is made. The words "front" and "rear" refer to directions toward and away from, respectively, a designated front end of a casing assembly 10, as identified below. The words "inner", "inwardly" and "outer", "outwardly" refer to directions toward and away from, respectively, a designated centerline or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. The terminology includes the words specifically mentioned above, derivatives thereof, and words of similar import.

Figure 6:
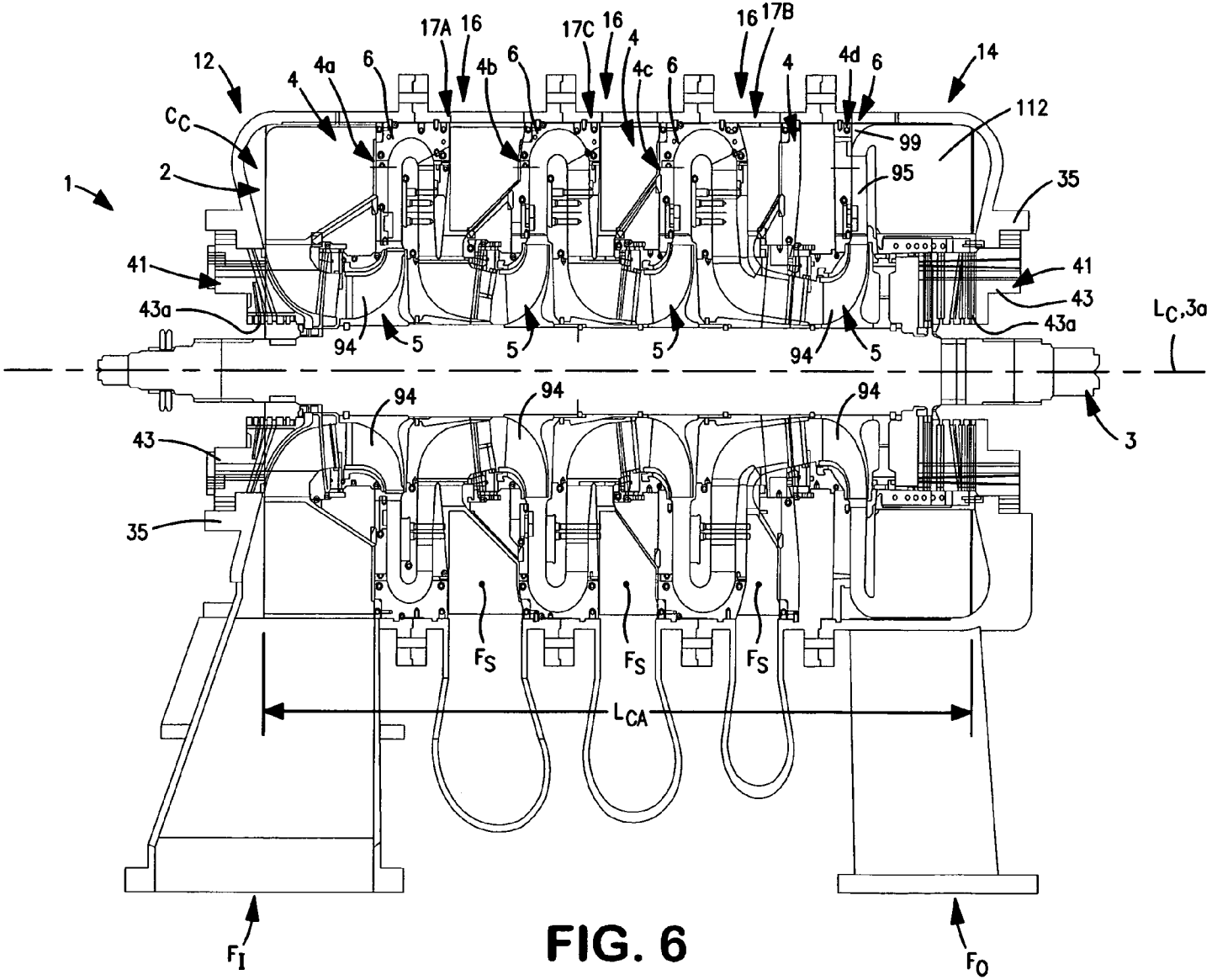
FIG. 6 is another axial cross-sectional view of the casing assembly, shown with an installed internal compression assembly.
Figure 7:
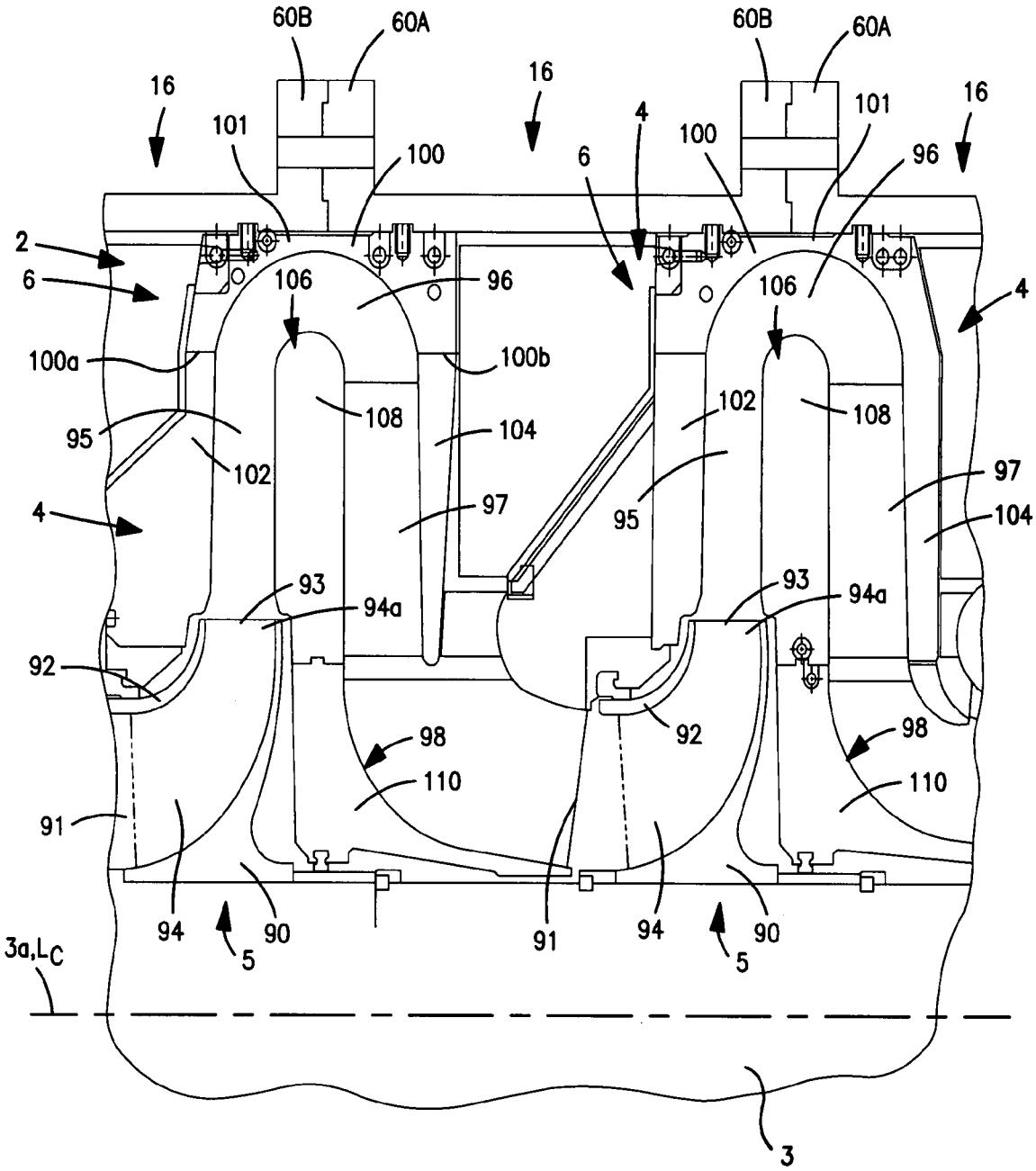
FIG. 7 is greatly enlarged, broken away view of a portion of the casing assembly shown in FIG. 6.

Referring now to the drawings in detail, wherein like numbers are used to indicate like elements throughout, there is shown in FIGS. 1-21 several exemplary constructions of a multi-segment casing assembly 10 for a compressor 1. The compressor 1 is preferably a centrifugal compressor that includes an internal compression assembly 2 having a shaft 3 rotatable about a central axis 3*a* and at least one and preferably several compressor stages 4, each stage 4 including an impeller 5 disposed on the shaft 3 and a flow path assembly 6 extending about the impeller 5, as best shown in FIGS. 6 and 7. The casing assembly 10 basically comprises a first end or inlet body segment 12, a second end or outlet body segment 14, and a selected number of intermediate body segments 16 disposed between the inlet and outlet segments 12, 14 to form a compressor casing 10. Specifically, a desired number of intermediate body segments 16 are preferably selected from a plurality of preformed or "preconstructed" intermediate body segments 16 as required to accommodate the size of the particular internal compression assembly 2, as described in further detail below. Additionally, the inlet body segment 12 has a fluid inlet $F_I$, the outlet body segment 14 has a fluid outlet $F_O$, and one or more of the intermediate body segments 16 may be provided with a separate fluid inlet $F_S$ as desired, as discussed below. When constructed, the casing assembly 10 has a front, inlet end 10*a*, an opposing rear, outlet end 10*b*, and a centerline $L_C$ extending generally horizontally between the ends 10, 10*b*. The inlet, intermediate and outlet body segments 12, 14, 16 are spaced axially along the centerline $L_C$ and the shaft central axis 3*a* is generally collinear with the centerline $L_C$ when the shaft 3 is disposed within the casing assembly 10. Further, the casing assembly 10 may be used to house a specific compression assembly 2 of an actual compressor product or as a manufacturing "test" assembly for testing internal assemblies 2 that are ultimately housed within a different casing (none shown).

Figure 5:
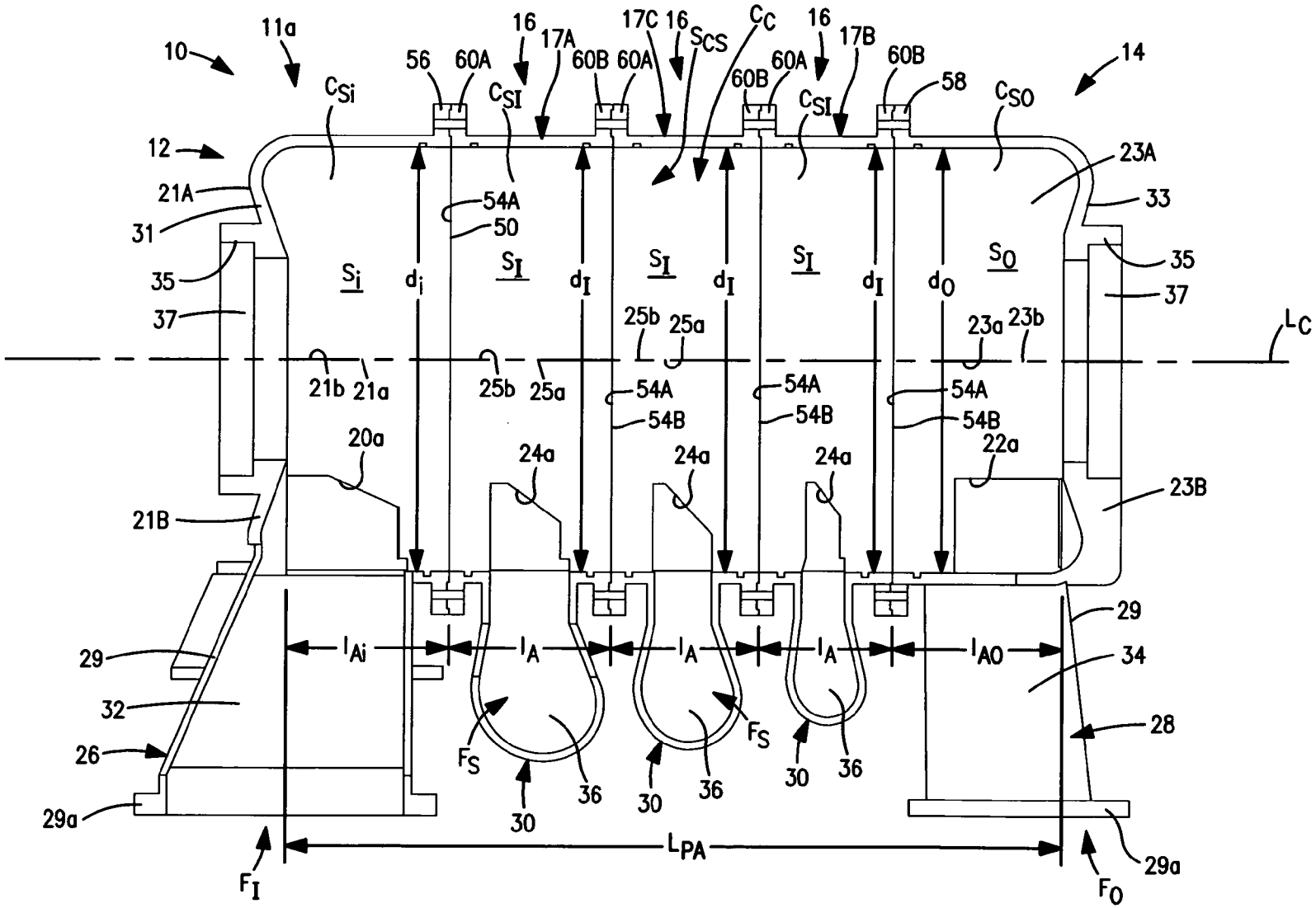
FIG. 5 is an axial cross-sectional view of the casing assembly of FIG. 1.
Figure 13:
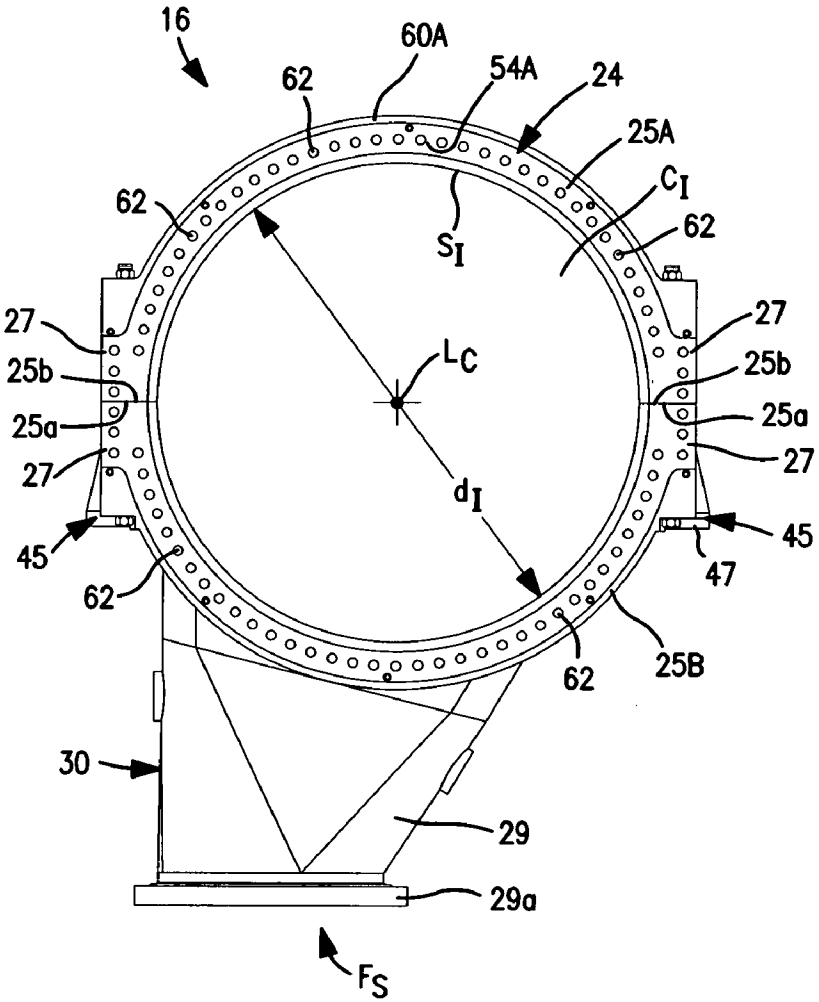
FIG. 13 is a front plan view of an intermediate segment of the casing assembly.
Figure 15:
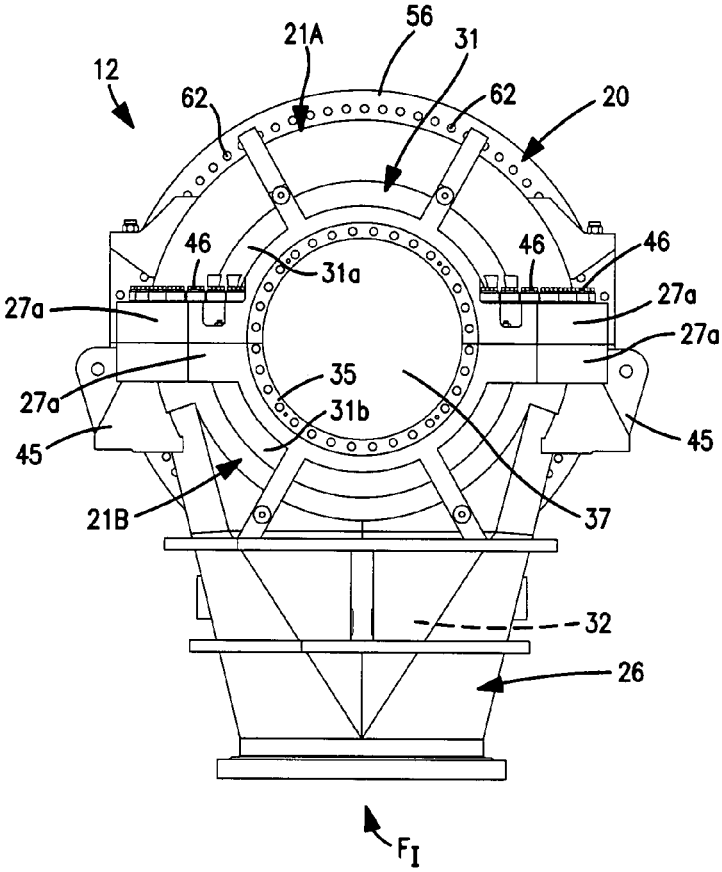
FIG. 15 is a front plan view of an inlet segment of the casing assembly.
Figure 21:
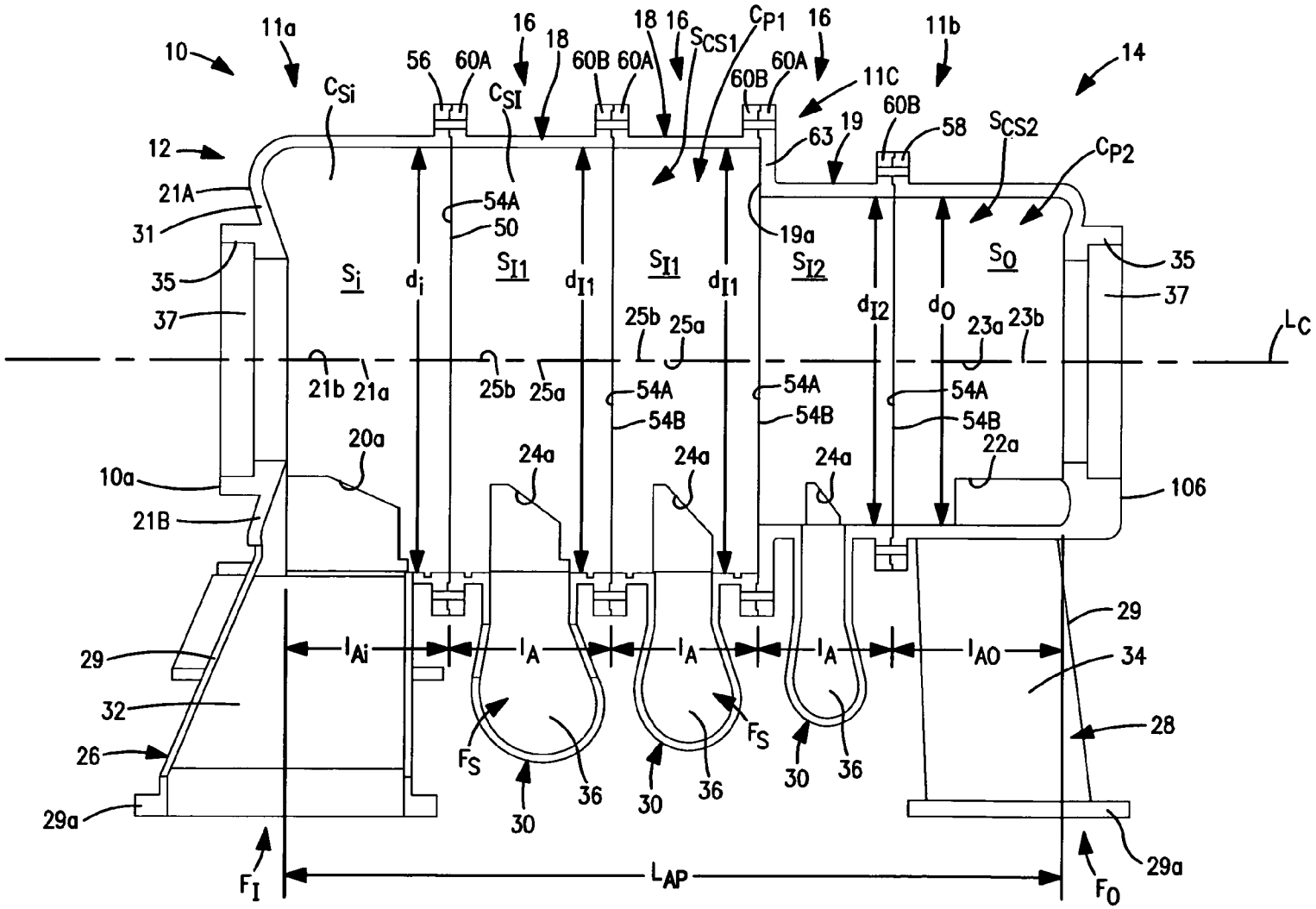
FIG. 21 is an axial cross-sectional view of the second embodiment casing assembly of FIG. 20.

Referring particularly to FIGS. 5, 13 and 21, each intermediate body segment 16 has an inner circumferential surface $s_I$ defining an interior chamber section $c_{SI}$ and having an inside diameter $d_I$, the surface $s_I$ preferably being generally circular and centered about the casing centerline $L_C$. The chamber sections $c_{SI}$ of the connected intermediate body segments 16 collectively define at least a portion of a compressor chamber $C_C$ sized to receive the internal compression assembly 2. In a first embodiment of the casing assembly 10 shown in FIGS. 5 and 13, the intermediate body segments 16 are constructed such that the intermediate segment inner surfaces $s_I$ have substantially equal inside diameters $d_I$. In other words, the inside diameter $d_I$ of each intermediate segment inner circumferential surface $s_I$ is preferably substantially equal to the inside diameter $d_I$ of each other intermediate segment inner surface $s_I$ and the inner surfaces $s_I$ are all generally coaxially aligned. As such, the inner surfaces $s_I$ of all the intermediate body segments 16 collectively define at least a portion of a generally continuous compressor support surface $S_{CS}$ configured to support at least a portion of a particular internal compression assembly 2, preferably in conjunction with the inner surfaces $s_i$, $s_O$ of the inlet/first end and outlet/second end segments 12, 14, as discussed below. By having such a continuous, circumferential support surface $S_{CS}$ and a compressor chamber $C_C$ collectively defined at least partially by the selected number of intermediate segments 16, the compressor casing 10 is configured to the specific, desired size of a particular compressor 1 and also readily adaptable to house a variety of different compressor sizes, as discussed below.

Figure 20:
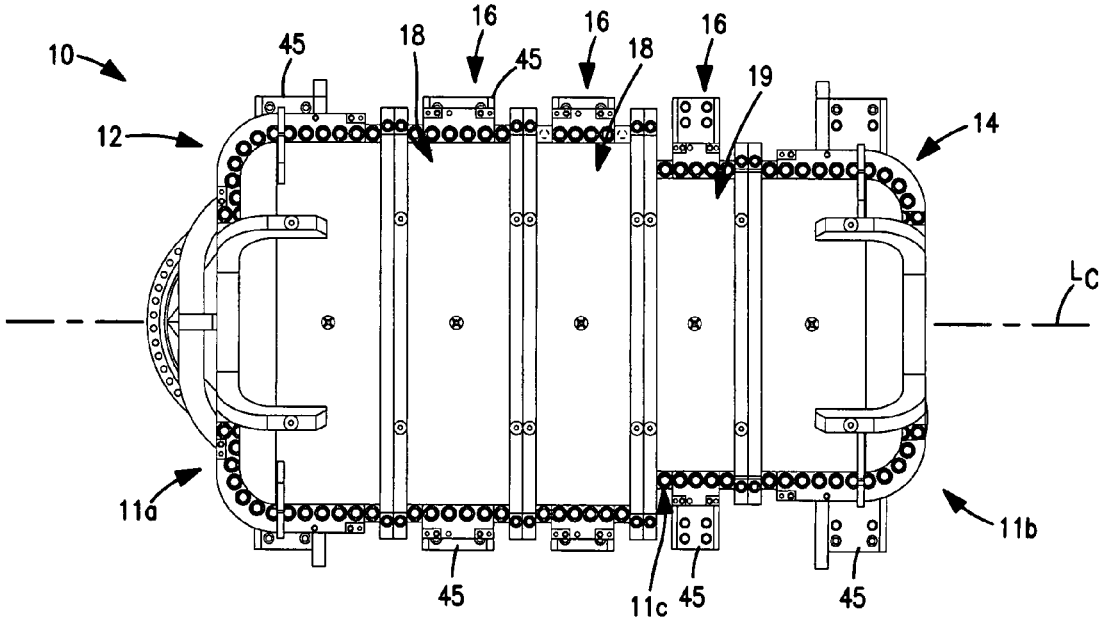
FIG. 20 is a top plan view of the casing assembly of FIG. 19.
Figure 19:
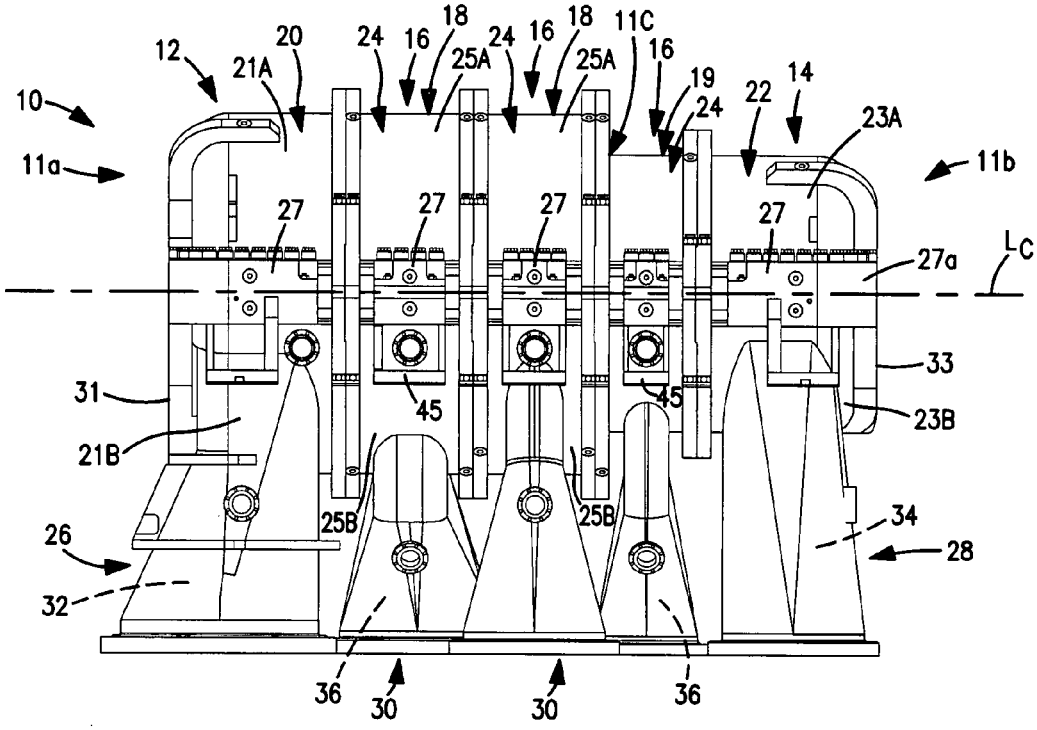
FIG. 19 is a side elevational view of a second embodiment of the casing assembly of the present invention.

Referring to FIGS. 19-21, a second embodiment of the compressor assembly 10 has at least one intermediate body segment 16 that is sized relatively radially smaller (or/and axially smaller) than one or more other intermediate segments 16, so as to provide a casing assembly 10 with distinct front and rear sections 11*a*, 11*b* and a "stepped" profile. The second embodiment casing assembly 10 includes at least two intermediate body segments 16; specifically, at least one first or "front", relatively radially-larger body segment 18 and at least one second or "rear", relatively radially-smaller body segment 19 with a front end 19*a* configured to connect with one of the front intermediate segment(s) 18. With this structure, the second embodiment casing assembly 10 provides a compressor chamber $C_C$ with two distinct chamber portions;

a first or "front", radially-larger chamber portion Cap and a second or "rear", radially-smaller chamber portion $C_{P2}$, as indicated in FIG. 21. Such a chamber construction may be preferable for certain applications of the compressor 1, particularly when used to house an internal compression assembly 2 that is constructed with one or more latter compressor stages 4 configured to provide a relatively smaller or lesser pressure increase, or/and lower flow capacity, compared with the one or more initial compressor stages 4. More specifically, the inner circumferential surface $s_I$ of each front intermediate body segment 18 has a first inside diameter $d_{11}$, each first diameter $d_{11}$ being substantially equal, and the inner surface $s_I$ of each rear intermediate segment 19 (only one shown) has a second inside diameter $d_{12}$, each second diameter $d_{12}$ being substantially equal and having a value substantially lesser than the first diameter(s) $d_{11}$. As such, the inner surfaces $s_I$ of the front intermediate body segments 18 collectively define at least a portion of a first generally continuous compressor support surface $S_{CS1}$ configured to support at least a portion of the front end of the internal compression assembly 2. Also, the inner surfaces $s_I$ of the rear body segments 19 collectively define at least a portion of a second generally continuous compressor support surface $S_{CS2}$ configured to support at least a portion of the compression assembly rear end. The first and second support surfaces $S_{CS1}$, $S_{CS2}$ are axially spaced apart and are both preferably centered about the casing centerline $L_C$, but one (or both) may be offset from the centerline $L_C$. Further, the compressor support surfaces $S_{CS1}$, $S_{CS2}$ and the compressor chamber portions $C_{P1}$, $C_{P2}$ are configured for a specific, desired internal compression assembly 2 and are also adaptable for use with different compression assembly structures, but the second embodiment casing assembly 10 is most useful for applications in which the latter compressor stage(s) 4 are radially smaller than the initial compressor stage(s) 4, as discussed above. Furthermore, it must be noted that, while the particular construction depicted in FIGS. 19-21 has a plurality of front intermediate body segments 18 and only a single rear intermediate body segment 19, the second embodiment casing assembly 10 may have any number of front and rear segments 18, 19. For example, the casing assembly 10 of the second embodiment may be constructed or formed with one front segment 18 and two rear segments 19, two or more front segments 18 and two or more rear segments 19, no front segments 18 and a single rear segment 19 (i.e., with a radially-larger inlet segment 12), etc.

Referring now to FIGS. 5, 13, 16, 17 and 21, the inlet and outlet body segments 12, 14 each preferably have an inner circumferential surface si, so, respectively, defining an interior chamber section $c_{Si}$, $c_{So}$, respectively, and having a respective inside diameter $d_i$, $d_o$. With the first casing embodiment, the inlet and outlet segment inside diameters $d_i$, $d_o$ are substantially equal to each other and to each intermediate segment inner surface diameter $d_I$. However, in the second embodiment, the inlet segment diameter $d_i$ is substantially equal to the inside diameter $d_{11}$ of each front intermediate segment 18 and the outlet segment diameter $d_o$ is substantially equal to the inside diameter $d_{12}$ of the one or more rear intermediate segment(s) 19. With both embodiments, the interior chamber sections $c_{Si}$, $c_{So}$, $c_{SI}$, of the inlet, outlet, and intermediate body segments 12, 14, 16, respectively, collectively define the entire compressor chamber $C_C$. (FIG. 6) or first and second compressor chamber portions $C_{P1}$, $C_{P2}$. Further, the inner surfaces $s_i$, $s_o$, $s_I$ of the two end segments 12, 14 and the one or more intermediate segments 16 are all generally coaxially aligned to collectively define the entire continuous compressor support surface $S_{CS}$ or the first and second support surfaces $S_{CS1}$, $S_{CS2}$. Alternatively, the inlet and outlet segments 12, 14 may be formed having one or more passages fluidly connected with a compressor chamber $C_c$ provided solely by the intermediate segment(s) 16 (structure not shown), such that the two segments 12, 14 only provide the inlet and outlets $F_I$, $F_O$ and do not house any portion of the internal compression assembly 2 other than a section of the shaft 3.

Further, it must be noted that each compressor support surface $S_{CS}$, $S_{CS1}$, $S_{CS2}$ is substantially "continuous" in the sense that the particular surface extends generally uniformly and generally without interruption between and through the adjacent casing segments 12, 14, 16. However, the compressor support surfaces $S_{CS}$, $S_{CS1}$, $S_{CS2}$ do typically include "local discontinuities", such as body segment ports 20*a*, 22*a*, and 24*a* (described below) and grooves and mounting holes (none indicated) for assembling the internal compression assembly 2 within the casing assembly 10. Furthermore, the inner surface $s_i$, $s_o$, $s_I$ of each casing body segment 12, 14, 16, respectively, is preferably substantially circular, such that the casing assembly support surface $S_{CS}$, or first and second surfaces $S_{CS1}$, $S_{CS2}$, and the respective chamber $C_C$ or chamber portions $C_{P1}$, $C_{P2}$ defined thereby, are each generally circular cylindrical shaped, but may be otherwise appropriately shaped (no alternatives shown).

As depicted in FIGS. 6 and 7, the specific internal compression assembly 2 for a particular compressor 1 has a predetermined size, as determined by the specific number of compressor stages 4 and the axial and radial size of the impellers 5, the flow channel assemblies 6, etc. As such, the number of intermediate body segments 16 is selected to provide the compressor chamber $C_C$ (or first and second chamber portions $C_{P1}$, $C_{P2}$) with a volume sufficient to receive the predetermined-sized compression assembly 2. More specifically, the compressor chamber $C_C$ has a volume proportional to the number of intermediate body segments 16, the specific number of segments 16 being selected to provide the chamber volume sufficient to receive the specific internal compression assembly 2 of a particular compressor 1. Alternatively, the number of intermediate body segments 16 may be selected to provide or collectively define a compressor chamber section $C_{CS}$ with a predetermined axial length $L_{PA}$, as indicated in FIGS. 5 and 21. That is, the compression assembly 2 may be formed having a particular axial length $L_{CA}$ (FIG. 6), such that the number of intermediate segments 16 is selected to provide a chamber axial length $L_{PA}$ of at least a portion of the compressor assembly length $L_{CA}$. As such that the compressor chamber $C_{CS}$ is sized to receive the particular compression assembly 2. Preferably, the plurality of intermediate body segments 16 are formed or constructed having substantially equal axial or standard axial lengths $l_A$ (e.g., 24", 36", etc.); in other words, such that each intermediate segment 16 has an axial length $l_A$ that is substantially equal to the axial length $l_A$ of each other intermediate body segment 16. With intermediate body segments 16 being formed in this manner, the number of segments 16 required may be determined by dividing the desired, predetermined chamber axial length $L_{PA}$ (minus the axial lengths of the inlet and outlet segments 12, 14, if providing portions of the chamber(s) $C_C$/$C_{P1}$, $C_{P2}$) by the standard segment length $l_A$.

Further, by being substantially continuous, the compressor support surface $S_{CS}$, or surfaces $S_{CS1}$, $S_{CS2}$, are each adapted or configured to support a variety of different-sized internal compression assemblies 2. For example, the compressor support surface $S_{CS}$ of a particular casing assembly 10, and thus the compressor 1, is configured to support a first internal compression assembly 2 including a first number of compressor stages 4 (e.g., four stages as shown in FIG. 6) and to alternatively support a second internal compression assembly 2 having a second, different number of compressor stages 4 (e.g., three stages, not shown). Such adaptability for various internal compression assembly structures is due to the continuous, generally circular circumferential compressor support surfaces $S_{CS}$ or $S_{CS1}$, $S_{CS2}$ and the respective generally circular cylindrical chamber $C_C$ or chamber portions $C_{P1}$, $C_{P2}$ defined thereby. Specifically, such continuous support surface(s) $S_{CS}/S_{CS1}$, $S_{CS2}$ permit a single compressor stage 4 to extend between or be housed by more than one body segment 12, 14 and/or 16, although multiple stages 4 may also or alternatively be housed in one or more of the body segments 12, 14, 16. As such, the casing assembly 10 is thereby capable of accommodating a variable number of compressor stages 4 along the length of the casing centerline $L_C$, as discussed below. However, with the second embodiment of the casing assembly 10, such adaptability permits compressor stages 4 to extend between adjacent intermediate body segments 18 of the front casing section 11*a* or between adjacent body segments 19 of the rear casing section 11*b* in a generally similar manner as the first embodiment casing, but larger-sized compressor stages 4 may not be positionable across the interface 11*c* between the casing sections 11*a*, 11*b*.

Referring to FIGS. 5 and 6, as an example, a compressor casing assembly 10 may be constructed of three intermediate body segments 16 each with an axial length $l_A$ of two feet (2'), such that the portion of the compressor support surface $S_{CS}$ provided by the intermediate segments 16 has an overall axial length of six feet (6'). These three intermediate segments 16 may contain or house three two-foot ((3) 2') compressor stages 4 (one stage per segment), six one-foot ((6) 1') stages 4 (i.e., two per segment), and four one and a half foot ((4) 1.5') stages 4 (one and half stages per segment). With the first two compression assemblies 2, each compressor stage 4 may either be contained within a single intermediate body segment 16 or be arranged between two adjacent segments 16, but in the third compression assembly 2, at least two of the compressor stages 4 must be contained partially within two separate, connected intermediate segments 16.

Figure 11:
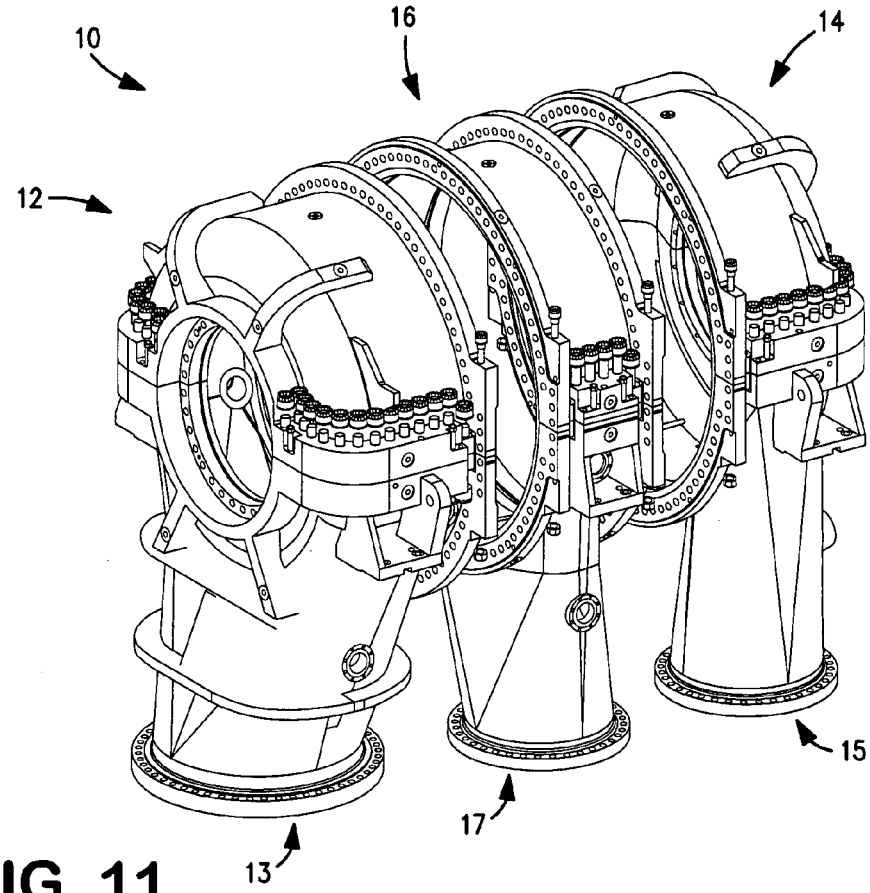
FIG. 11 is a partly exploded, front perspective view of the second casing assembly construction of FIG. 10.
Figure 10:
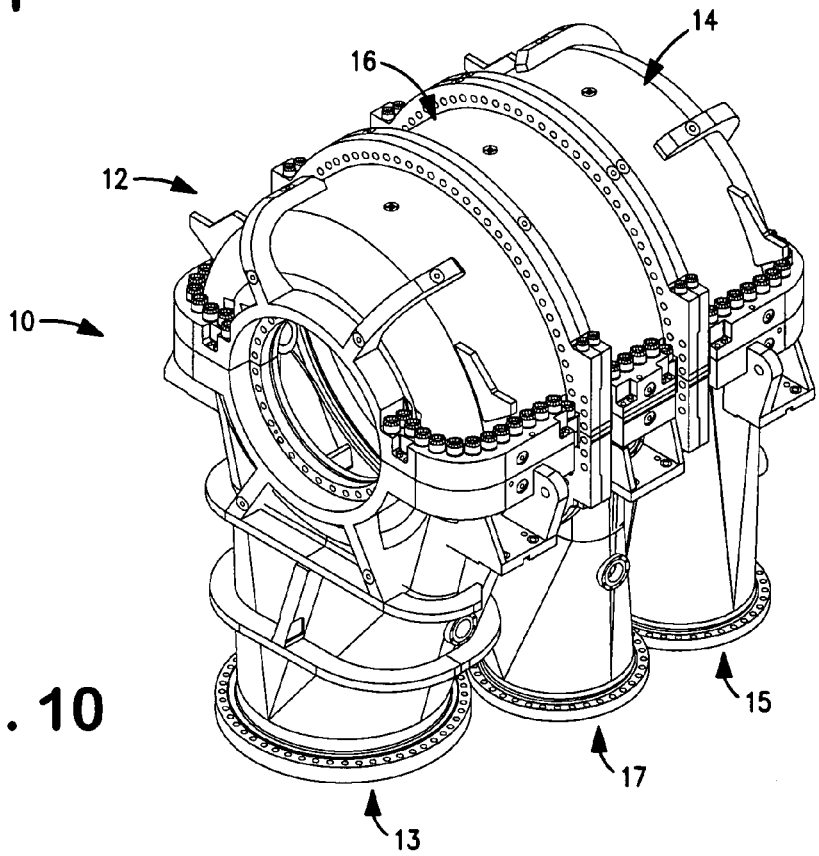
FIG. 10 is a front perspective view of a casing assembly in accordance with a second construction of the present invention.
Figure 12:
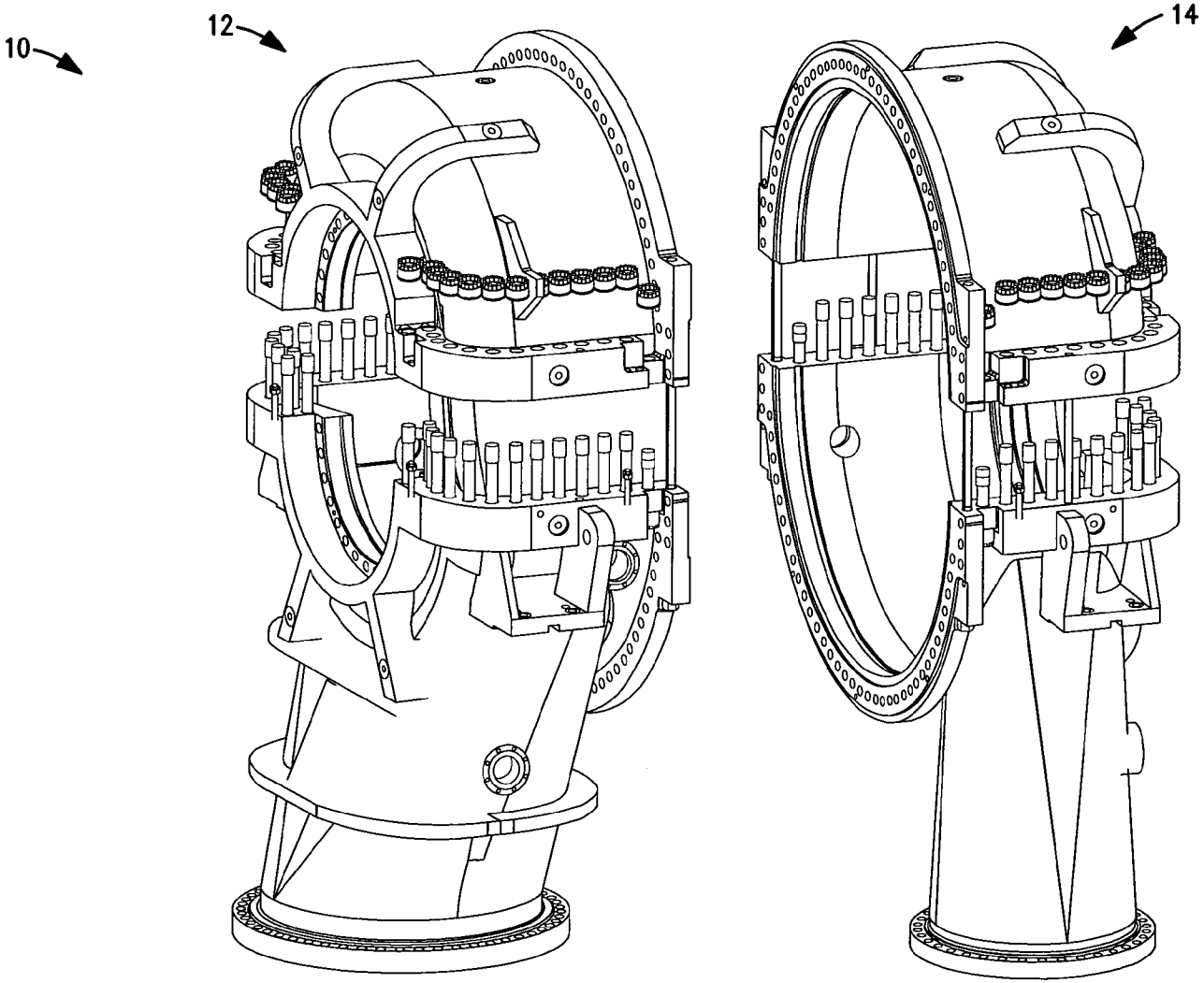
FIG. 12 is a partly exploded, front perspective view of a casing assembly in accordance with a third construction of the present invention.
Figure 14:
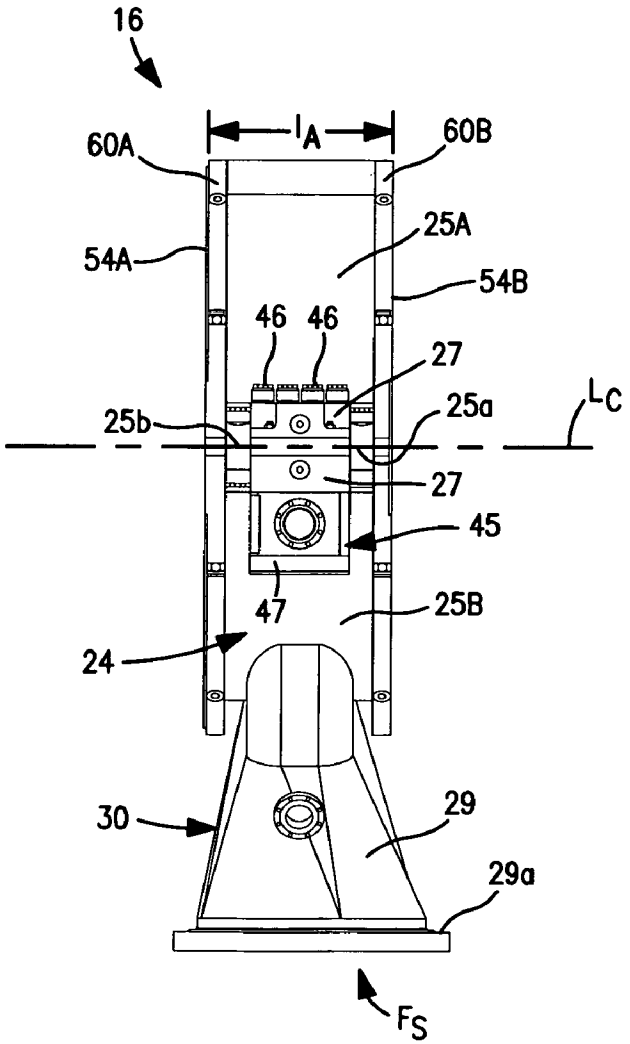
FIG. 14 is a side plan view of the intermediate segment of FIG. 13.

To further illustrate the benefits of the present casing assembly 10, a compressor manufacturer may fabricate a quantity of standard-sized intermediate body segments 16 (and inlet and outlet segments 12, 14), and then assemble a desired casing assembly 10 by selecting the number and type of the intermediate casing segments 16 that will accommodate a particular internal compression assembly 2, which often varies by the number of compression stages 4 and/or by size of the particular components thereof. As a first example, a casing assembly 10 may be formed without any intermediate segments 16; in other words, the selected number of intermediate segments 16 may be zero, such that the inlet and outlet body segments 12, 14 are directly connected together, as shown in FIG. 12. Referring to FIGS. 10 and 11, in another example, only one intermediate body segment 16 may be selected, such that assembled casing 10 includes the single intermediate segment 16 disposed between and directly connected with both the inlet and outlet segments 12 and 14. As a further example, the selected number of intermediate body segments 16 may be two, such that the casing assembly 10 includes a first intermediate body segment directly connected with the inlet body segment 12, and a second intermediate body segment directly connected with the outlet body segment 14 and with the first segment (assembly not shown).

As yet another example, the manufacturer may fabricate a casing assembly 10 by selecting greater than two intermediate body segments 16. As such, the casing assembly 10 includes at least a first intermediate body segment 17A directly connected with the inlet body segment 12, a second intermediate body segment 17B directly connected with the outlet body segment, and at least a third intermediate body segment 17C disposed between and directly connected with at least one of first and second intermediate body segments 17A, 17B. A casing structure with three segments 17A, 17B, 17C is primarily depicted in the drawing figures (see, e.g. FIGS. 1-9). Thus, the multi-segmented structure of the casing assembly 10 provides great flexibility for the compressor manufacturer, and enables compressors 1 of various, different sizes to be constructed from a quantity or supply of standard sized parts. Further, the plurality of intermediate segments 16 may all be formed of a common or single axial length $^1$A (as shown) or may be fabricated of two or more different axial lengths (e.g., $l_{A1}$, $l_{A2}$, etc. (not shown)).

As depicted in FIG. 1, the casing assembly 10 preferably further comprises a base 70 configured to receive and to support the inlet segment 12, the outlet segment 14 and the selected number of intermediate segments 16. The base 70 preferably includes a lower, frame portion 72 disposeable upon an environment surface $E_S$ (e.g., a factory floor, drilling platform, etc.) and an upper, support portion 74 connected with the frame portion 72. The support portion 74 is configured to retain the casing body segments 12, 14, 16 spaced generally above the surrounding surface $E_S$ (e.g., a factory floor, a ship deck, a drilling platform, etc.), as described in further detail below.

Having described the basic components and primary features above, these and other elements of the casing assembly 10 of the present invention are discussed in further detail below.

Referring to FIGS. 5, 6 and 13-21, each one of the inlet, outlet and intermediate body segments 12, 14, 16 preferably includes a generally annular main body section 20, 22, 24, respectively, which provides the inner circumferential surface $s_i$, $s_O$, $s_I$ and chamber section $c_{Si}$, $c_{SO}$, $c_{S1}$ of the particular casing body segment 12, 14, or 16. At least the inlet and outlet segments 12, 14, and in many cases one or more (or all) of the intermediate segments 16, each have a generally tubular "nozzle" section 26, 28, 30, respectively, extending generally radially from the respective main body section 20, 22, 24. The nozzle sections 26, 28, 30 each have a bore providing a fluid passage 32, 34, 36, respectively, and is coupled with a body port 20*a*, 22*a*, 24*a*, respectively, into the interior chamber section $c_{Si}$, $c_{So}$, $c_{SI}$ of the connected main body section 20, 22, 24. With the intermediate body segments 16, the fluid passage 36 provides a "sidestream" fluid inlet $F_S$ (FIG. 6) that is situated or positioned to direct fluid to a particular location of the internal compression assembly 2, specifically to direct fluid into an impeller inlet 91 of a second or latter stage 4 of the compressor 1, as discussed in further detail below.

Furthermore, the inlet and outlet segments 12, 14 each preferably further includes a generally radially-extending end wall section 31, 33, respectively, integrally connected with the respective annular main body section 20, 22 and enclosing one axial end of the main body section 20, 22. Each end wall section 31, 33 includes a generally circular hub 35 defining an opening 37 configured to receive a shaft support 41 (see FIG. 6). As shown in FIG. 6, the shaft support 41 preferably includes a generally cylindrical support body 43 with a throughbore 43*a* and bearing assembly (not shown) mounted in the bore 43*a*, a portion of the shaft 3 being disposed within the bearing to be rotatably supported thereby.

Figure 16:
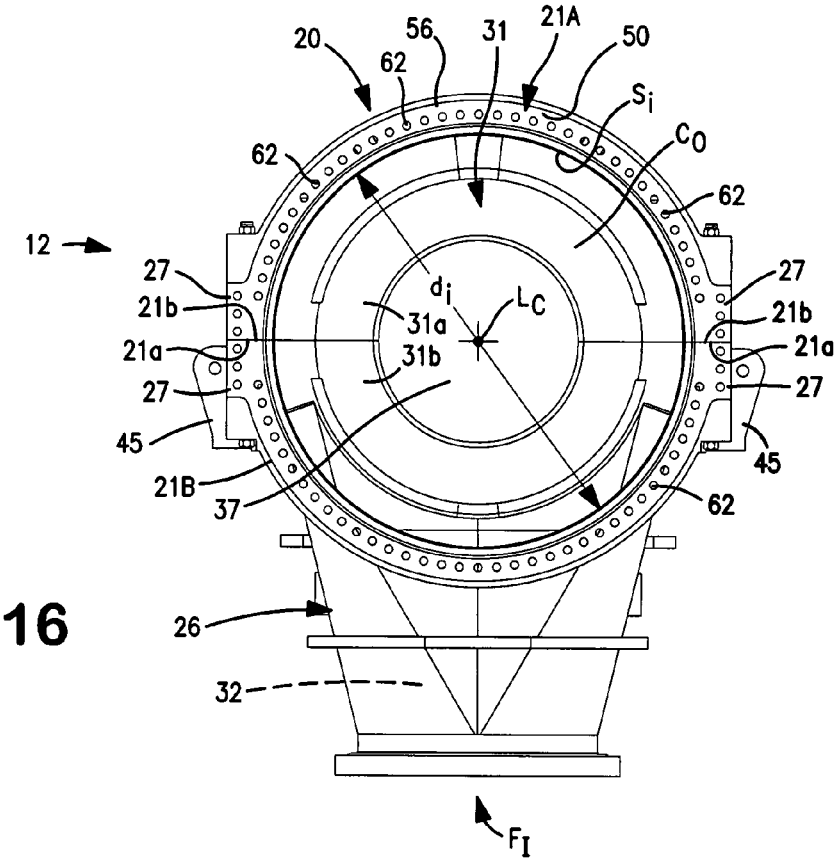
FIG. 16 is a rear plan view of the inlet segment of FIG. 15.
Figure 17:
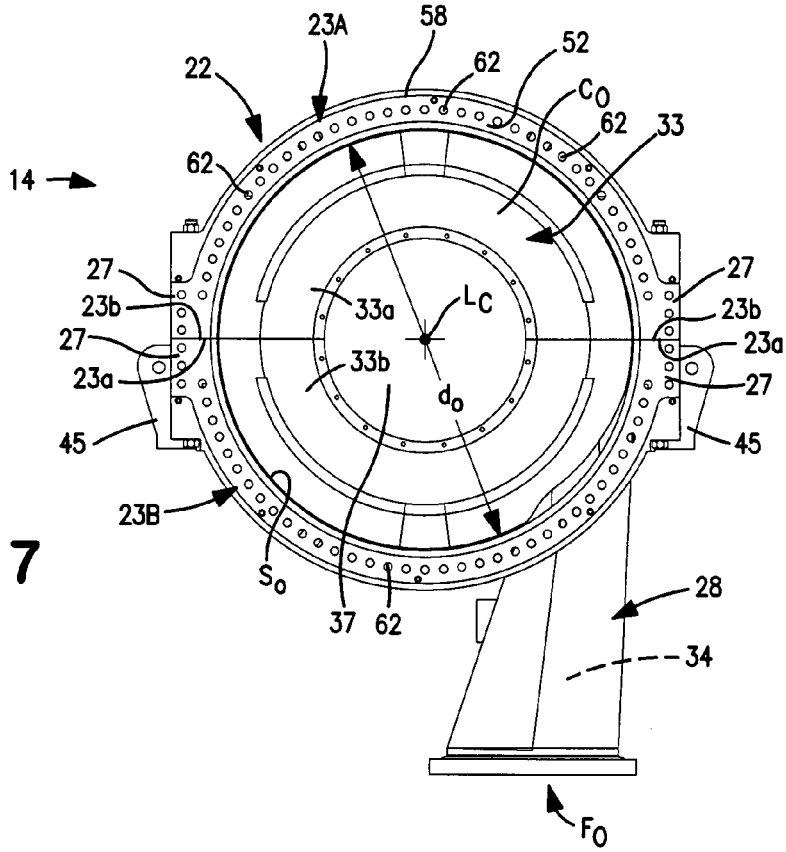
FIG. 17 is a front plan view of an outlet segment of the casing assembly.
Figure 18:
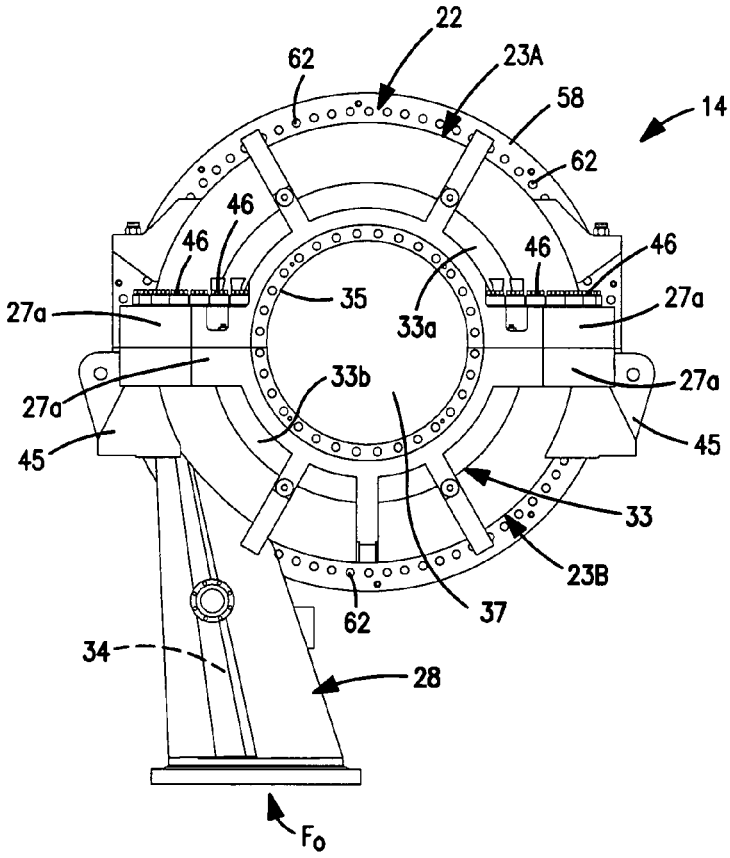
FIG. 18 is a rear plan view of the outlet segment of FIG. 17.

Referring to FIGS. 5, 8, 9 and 12-21, each one of the inlet, outlet and intermediate segments 12, 14, 16 is preferably fabricated so as to include first and second body halves 21A, 21B, 23A, 23B, and 25A, 25B, respectively, each having two opposing ends 21*a*, 21*b*, 23*a*, 23*b*, and 25*a*, 25*b* disposeable against an adjacent end of the other body half (see FIGS. 13, 16 and 17). Preferably, each one of the first and second body halves 21A, 21B, 23A, 23B and 25A, 25B is generally semi-circular shaped and connectable together to form the generally annular main body section 20, 22, 24, respectively. As indicated in FIGS. 15-18, each of the inlet and outlet body halves 21A, 21B and 23A, 23B further has a radial wall half 31*a*, 31*b* and 33*a*, 33*b*, respectively, providing the radial end walls 31, 33, respectively, as described above. Preferably, each pair of body halves 21A, 21B, 23A, 23B, and 25A, 25B is removably connected by means of a plurality of fasteners 46, most preferably bolts 46, to enable disassembly of the casing assembly 10 and/or to permit access to the internal compression assembly 2. More specifically, each body half end 21*a*, 21*b*, 23*a*, 23*b*, 25*a* and 25*b* has a radially and axially-extending mounting flange 27 disposeable against a proximal corresponding mounting flange 27 of the other body half and connected by the bolts 46. Also, the mounting flanges 27 of the inlet and outlet body segments 12, 14 each further have a radially-inwardly extending portion 27*a* connecting the radial wall halves 31*a*, 31*b* and 33*a*, 33*b* (see FIGS. 15 and 18). However, the two body halves 21A, 21B, 23A, 23B, 25A and 25B may alternatively be semi-permanently or permanently connected together by any other appropriate means, such as rivets, welding, etc. Additionally, any one or more of the casing segments 12, 14 and/or 16 may alternatively be formed as a separate, unitary body or as three or more connected together arcuate body portions (neither structure shown).

Figure 2:
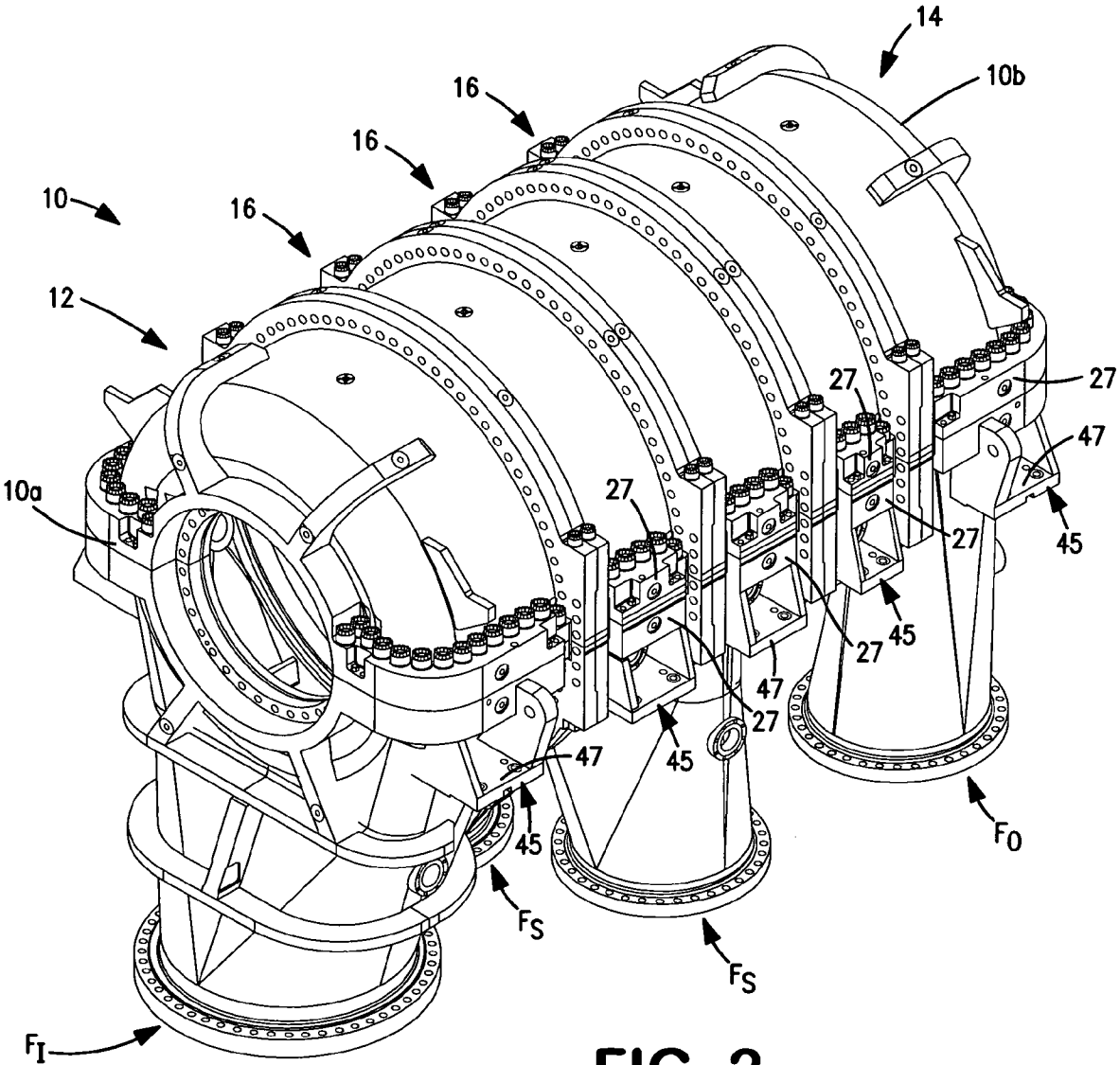
FIG. 2 is another front perspective view, viewed from the top, of the casing assembly of FIG. 1, shown without a casing base.
Figure 3:
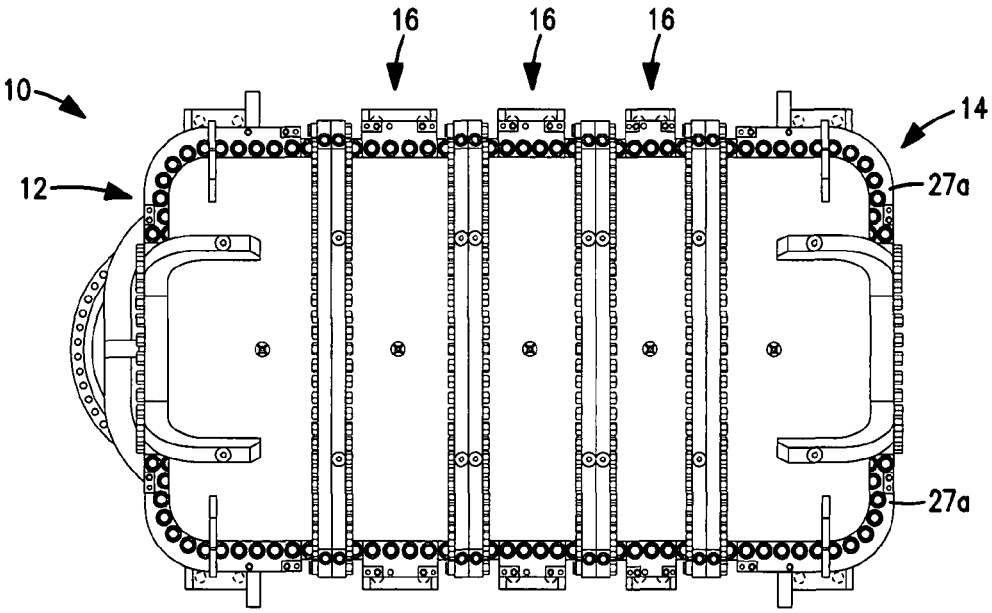
FIG. 3 is a top plan view of the casing assembly of FIG. 1.
Figure 4:
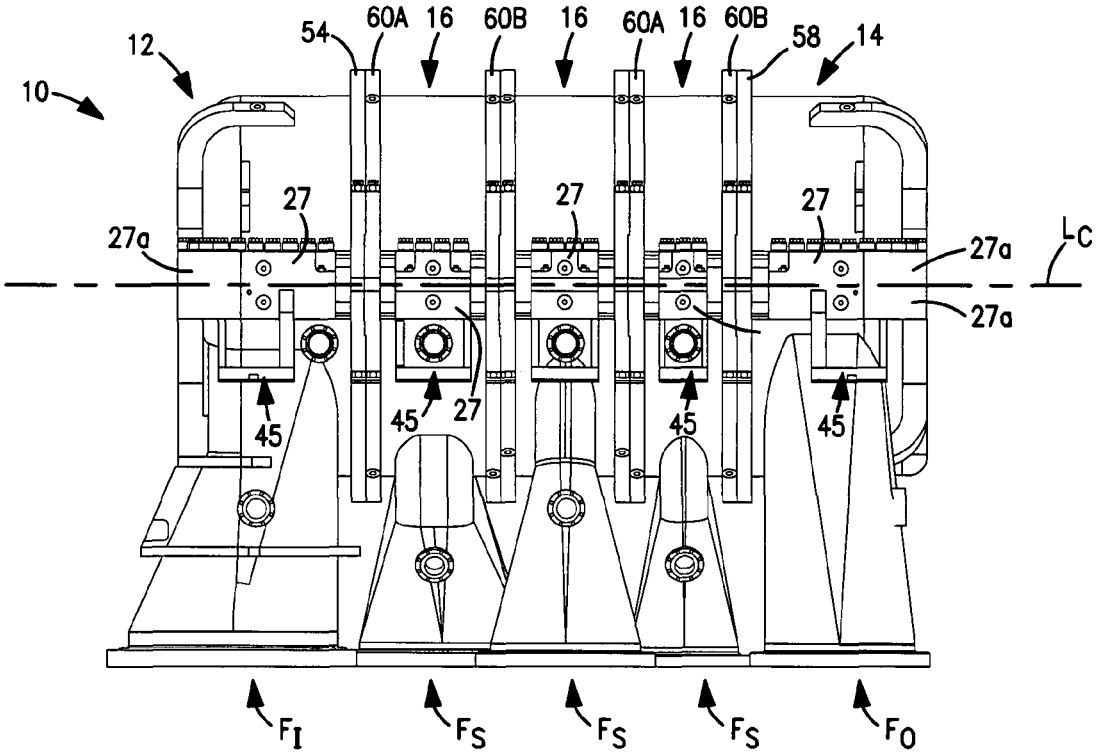
FIG. 4 is a side elevational view of the casing assembly of FIG. 1.
Figure 8:
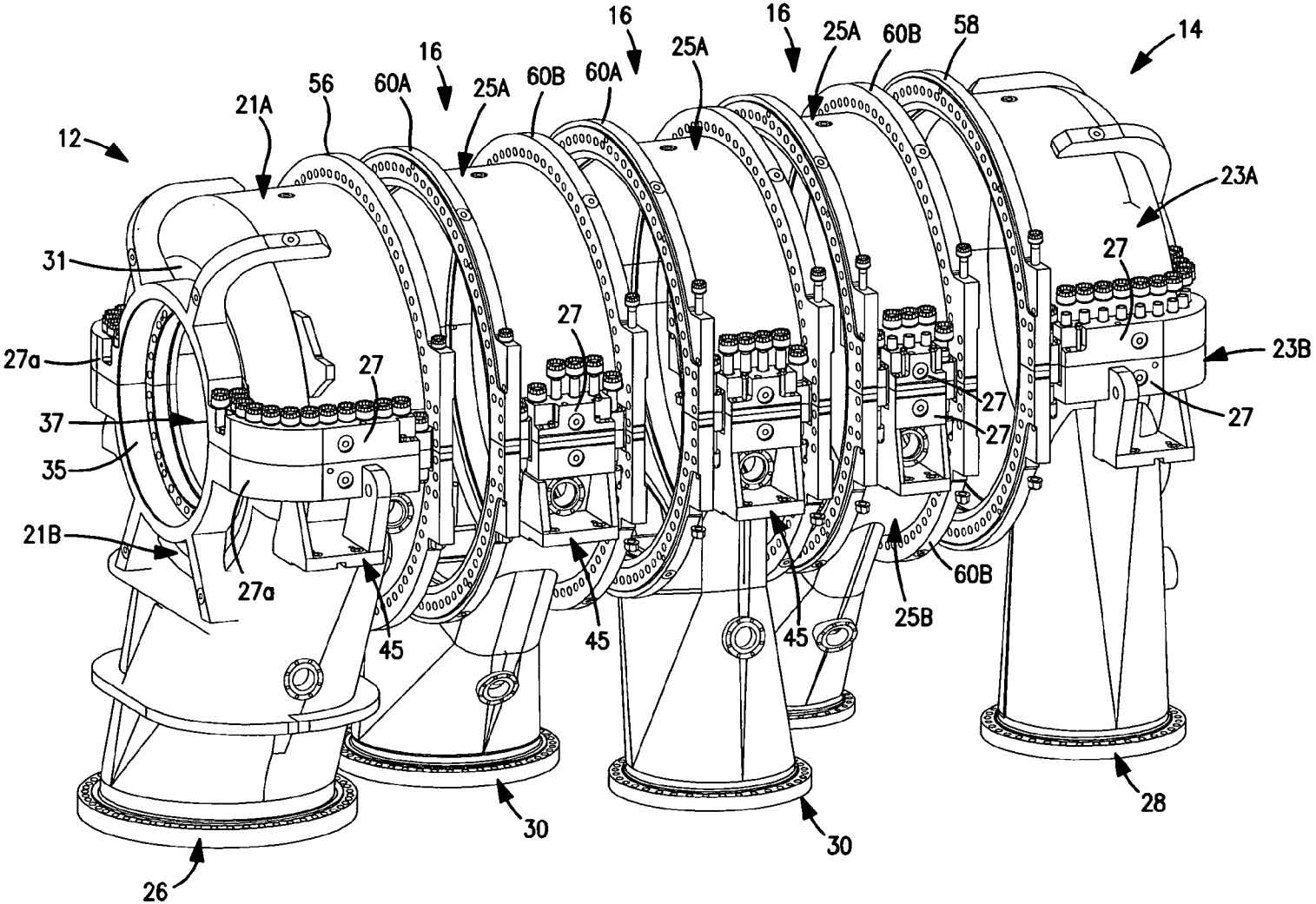
FIG. 8 is a partly exploded, perspective view of the casing assembly of FIG. 1, shown without fasteners.
Figure 9:
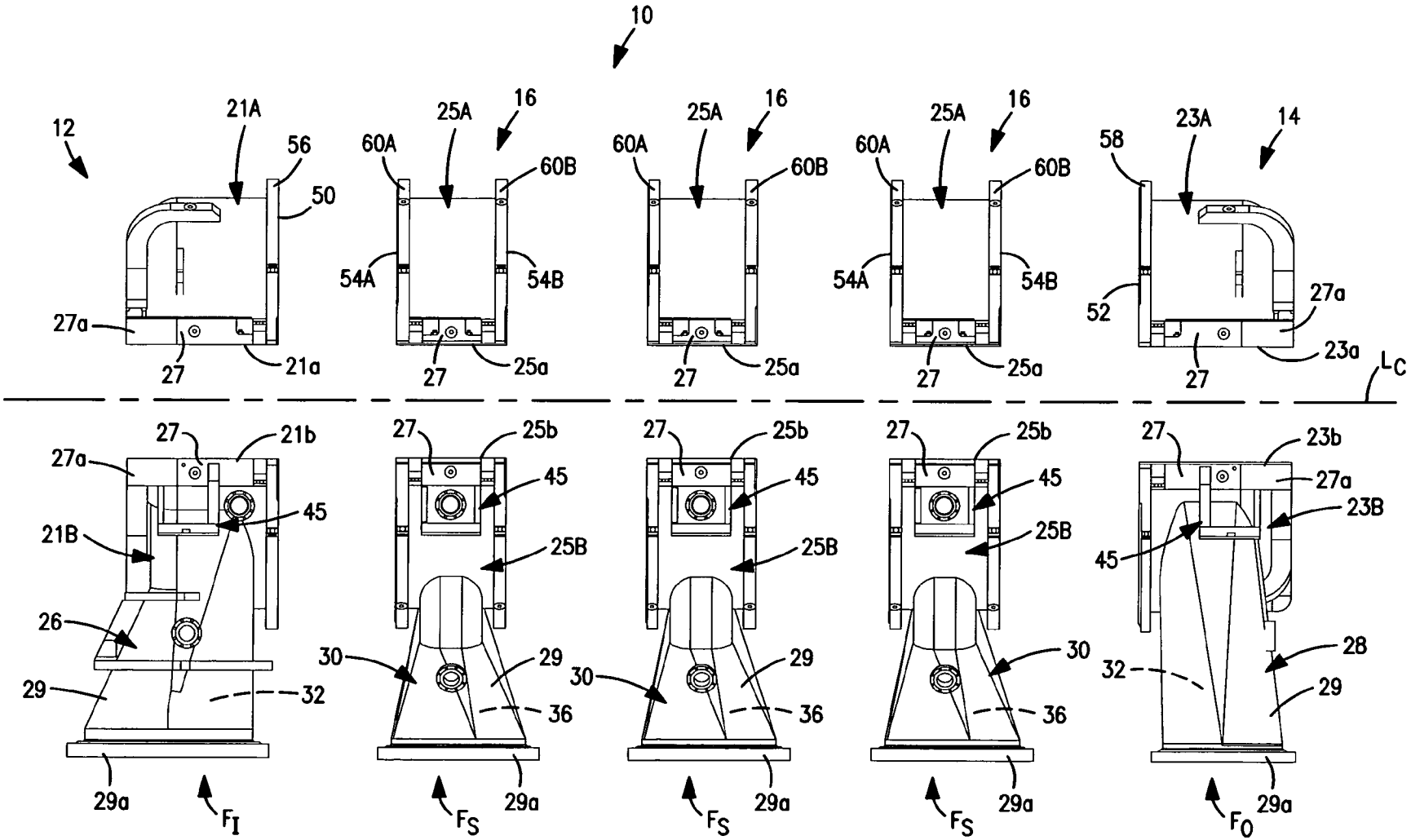
FIG. 9 is an exploded, side elevational view of the casing assembly of FIG. 1.

Furthermore, one of the two preferred body halves 21A, 21B and 23A, 23B of each of the inlet and outlet segments 12, 14 includes the generally tubular nozzle section 26, 28, as described above. One of the body halves 25A or 25B of one or more (or all) of the pairs of intermediate segment body halves 25A/25B may or may not be provided with the above-discussed tubular nozzle section 30. Most preferably, the lower body half 21B, 23B and 25B of the casing body segments 12, 14, 16, respectively, includes the nozzles 26, 28, 30 arranged such the nozzles extend generally vertically downwardly from the particular casing segment 12, 14, or 16. However, the nozzles 26, 28, 30 may alternatively be connected or formed with the upper body half 21A, 23A, 25A or/and extend generally or partly horizontally or vertically upwardly. To maximize space for connection of piping to the nozzles 26, 28, 30, the nozzles 30 of the intermediate body segments 16 are preferably arranged so as to be "staggered" along the casing centerline $L_C$, as best shown in FIGS. 2, 4 and 8. Further, each nozzle section 26, 28, 30 is preferably formed as a generally circular tube 29 having a generally circular flange 29*a* connectable with a fluid pipe (none shown). Additionally, each lower body half 21B, 23B and 25B includes a pair of mounting brackets 45, one located on each lateral side of the particular segment 12, 14 or 16 and generally below a separate one of the body flanges 27. The mounting brackets 45 are configured to connect the casing assembly 10 with the base 70, as discussed above and in further detail below. Preferably, each bracket 45 is formed so as to include a generally horizontally extending plate 47 with an inner end connected with the lower body half 21B, 23B, 25B and having a plurality of mounting holes (not indicated). As such, the casing body segments 12, 14, 16 are each mounted to the base 70 by a plurality of threaded fasteners 46 connecting the bracket plates 47 with the base support portion 74, as described in further detail below (see FIG. 1).

Referring to FIGS. 5, 8-14, 16 and 17, the inlet and outlet body segments 12, 14 each have a generally radially-extending inner end surface 50, 52, respectively, extending circumferentially about the casing centerline $L_C$. Also, each one of the intermediate body segments 16 has two opposing, generally radially-extending front and rear end surfaces 54A, 54B extending circumferentially about the casing centerline $L_C$. With this structure, each intermediate segment end surface 54A, 54B is disposed against the end surface 50, 52, 54A or 54B of either the inlet segment 12, the outlet segment 14, or another intermediate segment 16. Preferably, the inlet and outlet segments 12, 14 each have a generally annular mounting flange 56, 58, respectively and each intermediate segment 16 has two generally annular mounting flanges 60A, 60B, each flange providing one of the end surfaces 50, 52, 54A or 54B. Further, each intermediate segment flange 60A, 60B is disposed against and connected with the mounting flange 56, 58 of the inlet or outlet segments 12, 14, or one of the flanges 60B, 60A of another intermediate segment 16, and is most preferably removably connected by a plurality of threaded fasteners 46. More specifically, each mounting flange 56, 58, 60A, 60B has a plurality of mounting holes 62 which align with a hole 62 on a flange 56, 58, 60A, or 60B of an adjacent casing segment 12, 14, 16, and a fastener 64 is inserted through each pair of aligned holes 62 to removably secure each pair of adjacent casing segments 12/16, 14/16 or 16/16. Additionally, with the second embodiment of the casing assembly 10, the one rear intermediate body segment 19 that connects with the front casing section 10*a* at the casing interface 11*c* is an "adapter" body segment having a front flange 60A that is substantially radially larger than the other rear segment flanges 60A, 60B (only one shown) and has a radially-extending section 63 that encloses an annular space between the rearwardmost front intermediate body segment 18 and the adapter rear intermediate body segment 19.

Referring specifically to FIG. 1, the base frame portion 72 is formed as a generally rectangular box with two generally parallel, horizontal main beam members 75 and two generally parallel, horizontal cross beam members 76 extending between and connecting together the main beams 75. Further, the base support portion 74 preferably includes a plurality of generally vertical beam members 78 extending upwardly from each of the main beam members 75 and two spaced apart, generally horizontal support members 80 connected with the upper ends of the vertical beam members 78 and extending generally parallel with the frame main beam members 74. Each support member 80 has an upper surface 82 upon which the mounting brackets 45 of the casing segments 12, 14, 16 are disposed, the brackets 45 being connected with a proximal one of the support members 80, preferably by a plurality of threaded fasteners 46. Furthermore, the beams 75, 76, 78 and the support members 80 are preferably fixedly connected together, preferably by welding, but may riveted or otherwise fixedly connected, or may even be removably connected by threaded fasteners, etc. Although the structure depicted in FIG. 1 and described above is presently preferred, the base 70 may be formed in any appropriate manner that enables the base 70 to support the casing assembly 10, or the casing assembly 10 may be configured to be "self standing" and therefore not requiring a separate base or similar supporting structure.

Referring now to FIGS. 6-7, as discussed above, the casing assembly 10 is preferably used for a centrifugal compressor I that includes an internal compression assembly 2 with a plurality of stages 4 (e.g., 4*a*, 4*b*, 4*c*, 4*d*). As discussed above, each compressor stage 4 includes an impeller 5 mounted to the shaft 3 and a fixed flow channel assembly 6 disposed about the impeller 5 and configured to direct fluid between adjacent stages 4. Each impeller 5 basically includes a generally cylindrical hub 90, a generally conical shroud 92 spaced axially from the hub 90 and a plurality of blades 94 extending between the hub 90 and shroud 92 and spaced circumferentially apart from each other. The impellers 5 each have an inlet 91 extending about the shaft 3 and a plurality of outlets 93 defined between the outer radial blade ends 94*a* such that fluid is directed radially outwardly from the shaft axis. Further, each flow channel assembly 6 is preferably mounted within the casing assembly 10 by assembling the various structural components 100, 102, 104, 106 of the channel assembly 6 about an impeller 5 mounted on the shaft 3 so as to form one compressor stage 4.

Furthermore, each flow channel assembly 6 is preferably configured to provide a diffuser channel 95, a return bend channel 96, a return channel 97 and a guide vane 98. More specifically, each flow channel assembly 6 includes an outer, generally annular return bend member 100 having an outer surface 101 disposed against the inner surface(s) of one or more casing body segments 12, 14, or 16, and opposing axial ends 100*a*, 100*b*. A generally radially extending diffuser wall member 102 is attached to the return member "front" axial end 100*a* and a diaphragm box section 104 is attached the member "rear" end 100*b*. Further, a flow subassembly 106 is disposed axially between the diffuser wall member 102 and diaphragm section 104 and includes an outer disk-like bulb section 108 and an inner generally conical guide vane member 110. With this structure, fluid flow exiting an impeller 5 flows both radially and tangentially outwardly from the impeller outlets 93 so as to "swirl" in a generally spiral manner through the diffuser channel 95, is curved back inwardly toward the shaft 3 by the return bend channel 96, such that swirl is removed in the return channel 97 as the fluid flows back toward the shaft 3, and is diverted by the guide vane 98 to flow axially into the impeller inlet 91 of the adjacent or next compressor stage 4. However, the flow channel assembly 6 of the last compressor stage 4 includes only a diffuser channel 95 and a bend member 99 that directs fluid flow into a volute 112 prior to flowing out of the casing fluid outlet $F_O$. Further, in certain constructions, the compressor 1 also includes a generally tubular inner casing (not shown) disposeable within the compressor chamber and having a central bore configured to receive the internal compression assembly 2. Such an inner casing is particularly suitable when the casing assembly 10 is used to house an internal compression assembly 2 having a relatively lesser or smaller outside diameter, such that inner casing occupies an annular space between the outer surface of the internal compression assembly 2 (e.g., the outer surface of the return bend member 100) and the casing support surface $S_{CS}$.

Although preferably used for a centrifugal compressor 1, the casing assembly 10 of the present invention may be used with any other type of compressor or another type of fluid machinery. For example, the casing assembly 10 may be used to house a pump, an axial compressor, a combination separator compressor machine, a fluid separator, or any other fluid machine that requires a casing (no alternatives shown). The scope of the present invention encompasses these and all other appropriate applications of the casing assembly 10.

The casing assembly 10 of the present invention has a number of advantages over previously known compressor casing designs. By being formed of a selected number of intermediate segments 16, including constructions without any segments 16, the casing assembly 10 may be appropriately configured to accommodate a variety of different-sized internal compression assemblies 2, to thus provide a variety of compressors 1 having different pressure output capacities. More specifically, a compressor manufacturer may fabricate a plurality of each type of casing segments 12, 14 and 16 by means of standard casting and machining operations to create a supply of casing components, with some (or none or all) of the intermediate segments 16 being formed having sidestream nozzles 30 and some (or none or all) formed without. Thereafter, when a customer requests a compressor 1 of a specific output capacity (e.g., requiring four stages), the manufacturer fabricates the internal compression assembly 2 and then selects the required number and type of intermediate casing segments 16 to house the particular compression assembly 2. The selected intermediate body segments 16 may include one or more (or all) body segments 16 having a sidestream nozzle 30 providing a fluid inlet $F_S$ (or a fluid outlet), or may all be segments 16 without a nozzle 30. Then, the selected intermediate segments 16 are assembled so as to locate or position any desired sidestream nozzles 30 to direct fluid flow to a particular location on or in one or more compressor stages 4 of the compression assembly 2. For example, a casing assembly 10 may be formed with a sidestream nozzle 30 located at the second compressor stage 4*b* only, at both the third and fourth stages 4*c*, 4*d*, at each of the second, third and fourth stages 4*b*, 4*c*, 4*d*, with no sidestream nozzles, etc. Thus, by having the separate intermediate body segments 16 which each may or may not include a fluid inlet $F_S$, the compressor 1 may be provided with any desired arrangement of sidestream inlet flows depending on the intended compressor performance or output characteristics.

Further, with the first embodiment of the casing assembly 10 having at least the intermediate segments 16, and preferably all the casing body segments 12, 14 and 16, formed with inner surfaces $s_i$, $s_O$, $s_1$ that are each substantially identically sized and shaped as the other body segments 12, 14, 16 of the casing assembly 10, a particular casing assembly 10 has an interior chamber $C_C$ with a generally uniform shape (e.g., substantially circular cylindrical, etc.) along the centerline $L_C$. As such, the particular casing assembly 10 is configured or adapted to house a variety of different sized internal compression assemblies 2, as discussed in detail above. Furthermore, a particular casing assembly 10 is readily adaptable or convertible for different applications. For example, a specific casing assembly 10 may be initially constructed to include three intermediate body segments 16 so as to be used with a four-stage internal compression assembly 2. If the user desires to increase or reduce the number of compression stages 4, once the compression assembly 2 has been modified as desired, the particular casing assembly 10 may be adapted to the modified compression assembly 2 by adding or removing intermediate segments 16, or by substituting different segments 16 to add, remove or rearrange sidestream inlets $F_S$.

Finally, due to the relatively large size of certain classes of compressors 1, for example, having axial lengths ranging from about ten feet (10') to about thirty feet (30') and outside diameters in the range of about five feet (5') to about fifteen feet (15'), the present casing assembly 10 is much easier to fabricate than previous casing designs. Specifically, each casing segment 12, 14 and 16 requires relatively smaller casting molds and are much simpler to finish machine than a "unitary" casing assembly formed of two body halves with the overall length of the finished compressor, particularly when fabricated of two separate body halves 21A, 21B, 23A, 23B and 25A, 25B.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as generally defined the appended claims.

I claim:

1. A casing assembly for a compressor, comprising:

an inlet body segment having a fluid inlet;

an outlet body segment having a fluid outlet; and intermediate body segments each having an inner circumferential surface, wherein a selected number of the intermediate body segments are disposed between the inlet and outlet body segments, each of the selected number of intermediate body segments being connected with at least one of the inlet body segment, the outlet body segment and another one of the intermediate body segments to form a compressor casing, the inner circumferential surface of each of the selected number of intermediate body sections defining an interior chamber section, the interior chamber sections of the selected number of intermediate body segments collectively defining at least a portion of a compressor chamber sized to receive a first internal compression assembly including a first number of compressor stages and to alternatively receive a second internal compression assembly having a second number of compressor stages, the second number being different than the first number, wherein at least one first compressor stage of the first internal compression assembly has a first axial length and at least two second compressor stages of the second internal compression assembly have a second axial length, the second axial length being less than the first axial length.

2. The casing assembly as recited in claim 1, wherein the selected number of intermediate body segments is selected to provide the compressor chamber with a volume sufficient to receive the first and alternatively the second internal compression assemblies.

3. The casing assembly as recited in claim 1, wherein the first and second internal compression assemblies each have an axial length and the selected number of intermediate body segments is selected to provide the compressor chamber with an axial length of at least a portion of the axial length of the first or second internal compression assembly.

4. The casing assembly as recited in claim 1, wherein the first and second internal compression assemblies have an axial length, each of the intermediate body segments has an axial length, and the selected number of intermediate segments is selected to provide the compressor chamber with an axial length of at least a portion of the axial length of the first and second internal compression assemblies.

5. The casing assembly as recited in claim 1, wherein each one of the inlet and outlet body segments has an inner circumferential surface defining an interior chamber section, the interior chamber sections of the inlet, outlet and intermediate body segments collectively defining the entire compressor chamber.

6. The casing assembly as recited in claim 1, wherein one of:

the selected number of intermediate body segments is zero and the inlet and outlet body segments are directly connected together;

the selected number of intermediate body segments is two such that the compressor casing includes a first intermediate body segment directly connected with the inlet body segment and a second intermediate body segment directly connected with the outlet body segment and with the first intermediate body segment; and the selected number of intermediate body segments is greater than two such that the compressor casing includes at least a first intermediate body segment directly connected with the inlet body segment, a second intermediate body segment directly connected with the outlet body segment, and a third intermediate body segment disposed between the first and second intermediate body segments.

7. The casing assembly as recited in claim 1, wherein the casing assembly has a centerline and the inlet, the intermediate and outlet body segments being spaced axially along the centerline, a central axis of a shaft being generally collinear with the centerline when the shaft is disposed in the compressor casing.

8. The casing assembly as recited in claim 1, wherein first and second internal compression assemblies each have an outer circumferential surface, the inner circumferential surface of each of the selected number of intermediate body segments having an inside diameter that is substantially equal to the inside diameter of the inner circumferential surface of each other of the selected number of the intermediate body segments such that the inner circumferential surfaces of the inlet, outlet, and selected number of intermediate body segments collectively form a generally continuous inner circumferential support surface, the inner circumferential support surface being configured to receive and support the first or the second internal compression assembly such that the inner circumferential support surface extends coaxially about the outer circumferential surface of the first or second internal compression assembly.

9. The casing assembly as recited in claim 1, wherein the compressor casing has a centerline, the inner circumferential surface of each of the selected number of intermediate body segments is generally centered about the centerline and has an inside diameter that is substantially equal to the inside diameter of the inner circumferential surface of each other of the selected number of intermediate body segments, the inner circumferential surface of each of the selected number of intermediate body segments being spaced axially apart and located adjacent to the inner circumferential surface of at least one other of the selected number intermediate body segments such that the inner circumferential surfaces of the inlet, outlet, and selected number of intermediate body segments collectively form a generally continuous inner circumferential support surface configured to receive and support at least a portion of the first or second internal compression assembly.

10. The casing assembly as recited in claim 1, wherein at least one of the selected number of intermediate body segments has a fluid inlet and is positioned to direct fluid to a particular location of the first or second internal compression assembly.

11. The casing assembly as recited in claim 10, wherein the at least one of the selected number of intermediate body segment includes a generally tubular portion with a bore providing the fluid inlet of the at least one of the selected number of intermediate body segments.

12. The casing assembly as recited in claim 10, wherein at least another one of the selected number of intermediate body segments has a fluid inlet and is positioned to direct fluid to a particular location of the internal compression assembly, wherein the fluid inlet of each of the selected number of intermediate body segments are staggered.

13. The casing assembly as recited in claim 1, further comprising a base configured to receive and to support the inlet body segment, the outlet body segment and the selected number of intermediate body segments.

14. The casing assembly as recited in claim 13, wherein the base includes a lower, frame portion disposable upon a surrounding environment surface and an upper support portion connected with the lower, frame portion and configured to retain the inlet, outlet and selected number of intermediate body segments spaced generally above the surrounding surface.

15. The casing assembly as recited in claim 1, wherein each one of the inlet, outlet, and intermediate body segments includes a generally annular main body section, the main body section of each of the intermediate body segments providing the inner circumferential surface of each of the intermediate body segments.

16. The casing assembly as recited in claim 1, wherein each one of the inlet, outlet and intermediate body segments includes first and second body halves, one of the first and second body halves of each of the inlet and outlet body segments including a generally tubular section with a bore providing a fluid passage.

17. The casing assembly as recited in claim 16, wherein each one of the first and second body halves is generally semi-circular shaped and connectable together to form a generally annular main body section.

18. The casing assembly as recited in claim 1, wherein at least one of the selected number of intermediate body segments includes a generally annular main body section providing the inner circumferential surface of the intermediate body segment, and a generally tubular section extending generally radially from the main body section and having a bore providing a fluid passage, the inner circumferential surface providing the interior chamber section and the tubular section being fluidly coupled with the chamber section.

19. The casing assembly as recited in claim 1, wherein:

the compressor casing has a centerline;

the inlet and outlet body segments each have a generally radially-extending inner end surface extending circumferentially about the centerline; and each one of the selected number of intermediate body segments has two, opposing generally radially-extending end surfaces extending circumferentially about the centerline and disposed against the inner end surface of one of the inlet body segment, the outlet body segment, and another one of the selected number of intermediate body segments.

20. The casing assembly as recited in claim 1, wherein:

the inlet and outlet body segments each have a generally annular mounting flange; and each of the selected number of intermediate body segments has two generally annular mounting flanges, each being disposed against and connected with one of the two mounting flanges of one of the inlet body segment, the outlet body segment, and another one of the selected number of the intermediate body segments.

21. The casing assembly as recited in claim 20, wherein each of the two mounting flanges of each of the selected number of intermediate body segments is removably connected with one of the two mounting flanges of one of the inlet body segment, the outlet body segment, and another one of the selected number of the intermediate body segments by a plurality of fasteners.

22. The casing assembly as recited in claim 20, wherein each of the inlet, outlet, and intermediate body segments includes first and second body halves with two opposing ends, each end having a generally radially and axially extending mounting flange disposable against the mounting flange of another one of the ends.

23. The casing assembly as recited in claim 1, wherein the first and second internal compression assemblies each have a plurality of compressor stages, each of the plurality of compressor stages including an impeller disposed on the shaft and a fixed flow channel assembly disposed about the impeller, the fixed flow channel assembly including a diffuser channel, a return bend channel, a return channel and a guide vane.

24. A casing assembly for a compressor, the compressor having a centerline and including an internal compression assembly with a shaft rotatable about a central axis coaxially aligned with the centerline and at least one compressor stage with an impeller disposed on the shaft, the casing assembly comprising:

a first end body segment;

a second end body segment spaced along the centerline from the first end segment; and a plurality of intermediate body segments disposed between and connected with the first and second end segments to form a compressor casing, each of the plurality of intermediate body segments having an inner circumferential surface with an inside diameter, the inside diameter of the inner circumferential surface of each of the plurality of intermediate body segments being substantially equal to the inside diameter of the inner circumferential surface of each other of the plurality of intermediate body segments, the inner circumferential surfaces being generally coaxially aligned to collectively define at least a portion of a generally continuous compressor support surface configured to support at least a portion of the internal compression assembly, wherein at least one of the plurality of intermediate body segments includes an intermediate fluid inlet positioned to direct fluid to a particular location of the internal compression assembly, and wherein the compressor support surface is configured to support a first internal compression assembly including at least one first compressor stage having a first axial length and to alternatively support a second internal compression assembly including at least two second compressor stages, each second compressor stage having a second axial length, the second axial length being less than the first axial length.

25. The casing assembly as recited in claim 24, wherein the first end body segment includes a fluid inlet and the second end body segment includes a fluid outlet.

26. The casing assembly as recited in claim 25, wherein the intermediate fluid inlet of the at least one intermediate body segment, the fluid inlet of the first end body segment, and the fluid outlet of the second end body segment are staggered.

27. The casing assembly as recited in claim 24, wherein the compressor support surface is configured to support a first internal compression assembly including a first number of compressor stages and to alternatively support a second internal compression assembly having a second number of compressor stages, the second number being different than the first number.

28. The casing assembly as recited in claim 24, wherein the compressor support surface defines a compressor chamber sized to receive the internal compression assembly.

29. The casing assembly as recited in claim 24, wherein:

the first end body segment has a first inner circumferential surface defining a first interior chamber section;

the second end body segment has a second inner circumferential surface defining a second interior chamber section; and each of the inner circumferential surfaces of the intermediate body segments defines an intermediate interior chamber section, the first, second, and intermediate interior chamber sections collectively defining a compressor chamber sized to receive the internal compression assembly.

30. The casing assembly as recited in claim 24, wherein the first and second end body segments each have an inner circumferential surface with an inside diameter that is substantially equal to the inside diameter of each of the plurality of intermediate body segments, the inner circumferential surfaces of the first and second end body segments and the inner circumferential surfaces of the plurality of intermediate segments being substantially coaxially aligned to collectively define the entire compressor support surface.

31. The casing assembly as recited in claim 30, wherein the inner circumferential surface of each one of the first and second end body segments and of the plurality of intermediate body segments is substantially centered about and spaced along the centerline of the compressor.

32. The casing assembly as recited in claim 24, wherein the inner circumferential surface of each one of the plurality of intermediate body segments defines a separate interior chamber section, the interior chamber sections of the intermediate body segments collectively defining a compressor chamber sized to receive at least a portion of the internal compression assembly.

33. The casing assembly as recited in claim 24, wherein each one of the first and second end body segments and the plurality of intermediate body segments includes a generally annular main body section, the main body section of each of the plurality of intermediate body segments providing the inner circumferential surface.

34. The casing assembly as recited in claim 33, wherein each of the first and second end body segments includes a generally radially-extending end wall section integrally formed with an axial end of the annular main body section, the radially-extending end wall section of each of the first and second end body segments including a central opening configured to receive a portion of the shaft.

35. The casing assembly as recited in claim 24, wherein each one of the first and second end body segments and the plurality of intermediate body segments includes first and second body halves, at least one of the first and second body halves of each of the first and second end body segments including a generally radially-extending tubular section with a bore providing a fluid passage.

36. The casing assembly as recited in claim 35, wherein each one of the first and second body halves is generally semi-circular shaped and connectable with another one of the first and second body halves to form a generally annular main body section.

37. The casing assembly as recited in claim 35, wherein at least one of the plurality of intermediate body segments includes a generally radially-extending tubular section with a bore providing a fluid passage.

38. The casing assembly as recited in claim 24, wherein:

the casing has a casing centerline;

the first and second end body segments each have a generally radially-extending inner end surface extending circumferentially about the casing centerline; and each one of the plurality of intermediate end segments has two, opposing generally radially-extending end surfaces extending circumferentially about the casing centerline and disposed against one of the end surfaces of one of the first end body segment, the second end body segment, and another one of the plurality of intermediate body segments.

39. The casing assembly as recited in claim 24, wherein:

the first and second end body segments each have a generally annular mounting flange; and each of the plurality of intermediate body segments has two generally annular mounting flanges disposed against and connected with the mounting flange of one of the first end body segment, the second end body segment, and another one of the plurality of intermediate body segments.

40. The casing assembly as recited in claim 39, wherein each of the first end body segment, the second end body segment, and the plurality of intermediate body segments includes first and second body halves each with two opposing ends, each of the first and second body halves having a generally radially and axially extending mounting flange, the mounting flange of each first body half being disposable against and connectable with the mounting flange of at least one of the second body halves.

41. The casing assembly as recited in claim 24, further comprising a base configured to receive and to support the first end body segment, the second end body segment and the plurality of intermediate body segments.

42. A casing assembly for a compressor, the compressor including an internal compression assembly having a shaft rotatable about a central axis and at least one compressor stage with an impeller disposed on the shaft, the casing assembly comprising:

an inlet body segment having a fluid inlet;

an outlet body segment having a fluid outlet;

at least one first intermediate body segment connected with the inlet body segment and having an inner circumferential surface with a first inside diameter, the at least one first intermediate body segment and the inlet body segment defining a first interior compressor chamber configured to receive a first compression assembly including a first compressor stage having a first axial length and, alternatively, to receive a second compression assembly including a second compressor stage having a second axial length, wherein the first and second axial lengths are different;

at least one second intermediate body segment connected with the outlet body segment and with the at least one first intermediate body segment to form a compressor casing, the at least one second intermediate body segment having an inner circumferential surface with a second inside diameter, the first inside diameter being substantially larger than the second inside diameter; and at least one intermediate fluid inlet extending from the at least one first intermediate body segment, the at least one second intermediate body segment, or both, the intermediate fluid inlet positioned to direct fluid to a particular location of the internal compression assembly.

43. The casing assembly as recited in claim 42, wherein each of the at least one first intermediate body segment includes a generally annular main body section providing the inner circumferential surface of the first intermediate body segment and each second intermediate body segment includes a generally annular main body section providing the inner circumferential surface of the second intermediate body segment.

44. The casing assembly as recited in claim 43, wherein the annular main body section of each of the at least one first intermediate body segments has a first outside diameter and the annular main body section of each of the at least one second intermediate body segment has a second outside diameter, the first outside diameter being substantially larger than the second outside diameter.

45. The casing assembly as recited in claim 42, wherein each one of the inlet, outlet, at least one first intermediate and at least one second intermediate body segments includes first and second connected body halves, one of the first and second body halves of each of the inlet and outlet body segments including a generally radially extending tubular section with a bore providing a fluid passage.

46. A method of forming a casing assembly for a compressor including an internal compression assembly having a shaft rotatable about a central axis and at least one compressor stage with an impeller disposed on the shaft, the at least one compressor stage having an axial length, the method comprising:

providing an inlet body segment having a fluid inlet and an outlet body segment having a fluid outlet;

providing a plurality of intermediate body segments, each intermediate body segment having an inner surface defining an interior chamber section and an axial length;

selecting a number of intermediate body segments from the plurality of intermediate body segments such that the selected number of intermediate body segments collectively define a compressor chamber section with a predetermined length, the predetermined length being at least a portion of the length of the at least one compressor stage such that the compressor chamber section is sized to receive at least a portion of the internal compression assembly;

connecting the selected number of intermediate body segments at least one of with each other and with the inlet and outlet body segments to form a casing assembly; and encasing a first internal compression assembly including a first number of compressor stages with the casing assembly and alternatively encasing a second internal compression assembly having a second number of compressor stages with the casing assembly, the second number being different than the first number, wherein at least one of the compressor stages of the first compression assembly has a first axial length and at least one of the compressor stages of the second compression assembly has a second axial length that is different from the first axial length.

47. The casing assembly method as recited in claim 46, wherein the axial length of each one of the plurality of intermediate body segments is substantially equal to the axial length of each other of the plurality of intermediate body segments.

48. A method of forming a casing assembly for a compressor comprising:

providing an inlet body segment having a fluid inlet and an outlet body segment having a fluid outlet;

providing a plurality of intermediate body segments, at least one of the intermediate body segments being an intermediate inlet body segment having a fluid inlet;

selecting a number of the intermediate body segments, the number of intermediate body segments one of including the at least one intermediate inlet body segment and excluding the at least one intermediate inlet segment;

connecting the selected number of intermediate body segments at least one of with each other and with the inlet and outlet body segments to form a casing assembly, disposing a first compression assembly in the casing assembly, wherein the first compression assembly includes a first compression stage having a first axial length;

removing the first compression assembly from the casing assembly; and disposing a second compression assembly into the casing assembly, without changing the number of intermediate body segments, wherein the second compression assembly includes a second compression stage having a second axial length that is different than the first axial length.

49. The casing assembly method as recited in claim 48, wherein the fluid inlet of the at least one intermediate inlet body segment is positionable to direct fluid to a particular location of the internal compression assembly.

* * * * *